74-424.8 SR
10/22/85 XR 4,548,298

United States Patent [19]
Born

[11] Patent Number: 4,548,298
[45] Date of Patent: Oct. 22, 1985

[54] ROTOR AND SCREW ELEVATOR EQUIPPED WITH A FAIL-SAFE CONTROL SYSTEM

[76] Inventor: Raymond W. Born, 17282 Mt. Wynne Cir., Fountain Valley, Calif. 92708

[21] Appl. No.: 480,597

[22] Filed: Mar. 30, 1983

Related U.S. Application Data

[63] Continuation-in-part of Ser. No. 197,264, Oct. 15, 1980, abandoned, which is a continuation-in-part of Ser. No. 944,601, Sep. 2, 1978, abandoned.

[51] Int. Cl.[4] ..... B66B 11/04
[52] U.S. Cl. ..... 187/25; 187/52 R; 74/424.8 R; 138/114
[58] Field of Search ..... 187/24, 25, 17, 30, 187/34, 32, 47, 51, 52 R, 56, 57; 254/7 R, 98; 138/114, 148; 74/459, 424.8 R

[56] References Cited

U.S. PATENT DOCUMENTS

| | | | |
|---|---|---|---|
| 1,970,286 | 8/1934 | Dunn | 187/52 R |
| 3,120,880 | 2/1964 | Joseph | 187/17 |
| 3,474,925 | 10/1969 | McCartney et al. | 187/25 |
| 3,802,290 | 4/1974 | Grove et al. | 74/459 |

FOREIGN PATENT DOCUMENTS

| | | | |
|---|---|---|---|
| 2045204 | 10/1980 | United Kingdom | 187/25 |

*Primary Examiner*—Joseph J. Rolla
*Assistant Examiner*—Kenneth Noland
*Attorney, Agent, or Firm*—Sellers and Brace

[57] ABSTRACT

The invention comprises two embodiments of a hydraulically powered rotor and screw elevator equipped with a fail-safe control system. In each embodiment a dual lead steep-pitched screw is embraced by a rotor supporting the cab. In one embodiment the rotor is driven and in the other the screw is driven. In each embodiment the driven component auto-rotates during downward cab travel and is hydraulically driven during upward cab travel by a motor-pump unit. This unit functions as a motor during upward cab travel and as a pump during downward cab travel to provide pressurized fluid to various system components including the hydraulic speed control components. Pressurized fluid is supplied in varying volumes by a plurality of pumps connected in parallel. Both the rotor and the screw are equipped with fail-safe brakes. The driven component in each embodiment includes a normally closed brake releasable by a fail-safe control system including switches, relays and valves cooperating to safeguard against non-functional components and all hazards. The screw may be a tube supported from the upper end of a coaxial tube embracing both the tubular screw and its rotor, the supporting tube being slotted to accommodate brackets between the rotor and the cab or other load.

65 Claims, 23 Drawing Figures

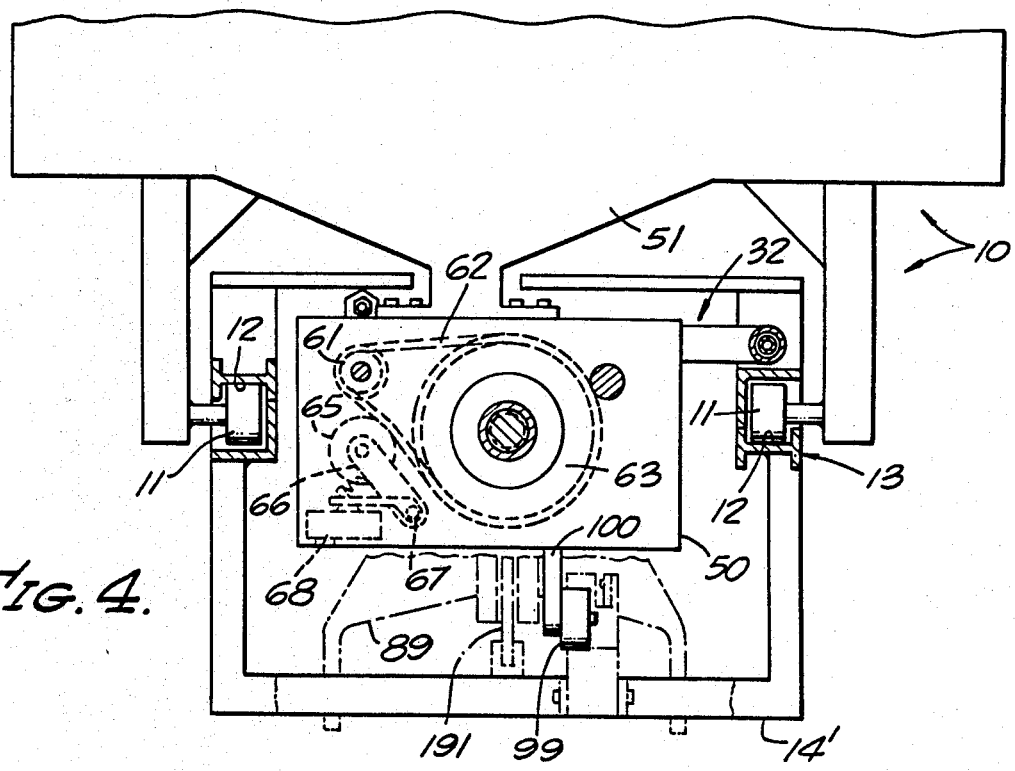
FIG. 4.
FIG. 5.
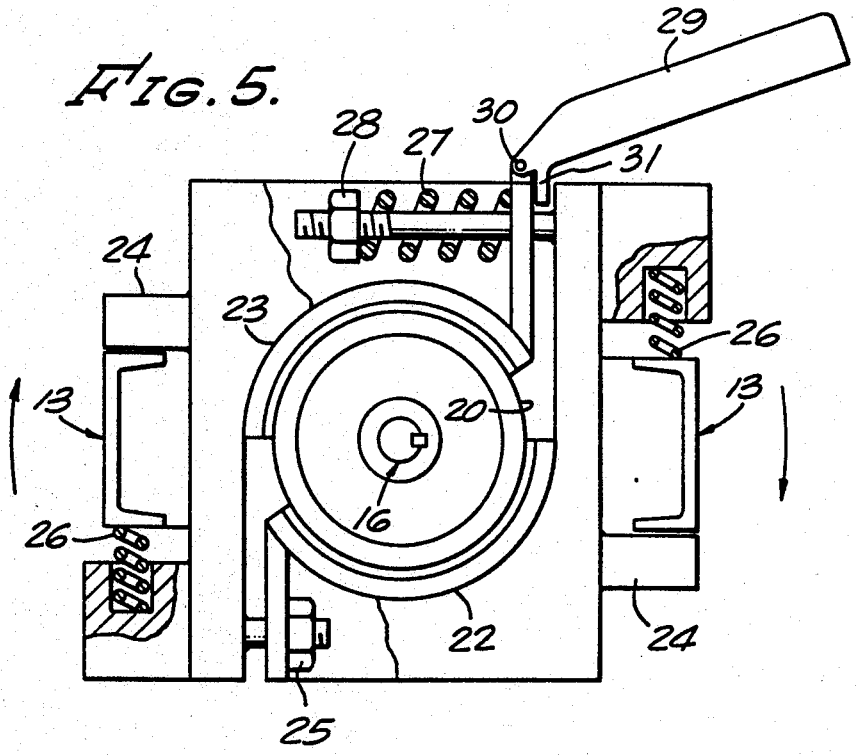

MOTOR-PUMP
NO
BR
NC
HSO
DOOR
TO LOCK
NO
SC
V REG
P 10
P 5
DCE
NC
NO
NC
A
B
T
E
C
101
102
103
104
105
107
108
109
110
112
113
115
116
117
118
119
121
125
126
130
131
132
133
134
135
136
137
138
140
140A
141
145
146
147
149
150
154
155
156
158
160
161
162
164
165
166
167
168
170
171
172
173
174
175
176
177
178
179
180
47
48
48'
56
56'
58
58'
59
60
60'
74
83

ROTOR AND SCREW ELEVATOR EQUIPPED WITH A FAIL-SAFE CONTROL SYSTEM

This application is a continuation-in-part of my copending application Ser. No. 06/197,264 filed Oct. 15, 1980, now abandoned which was a continuation-in-part of my application Ser. No. 944,601 filed Sept. 2, 1978 and now abandoned.

This invention relates to elevator systems, and more particularly to a unique rotor and screw elevator system equipped with a fail-safe mechanical, hydraulic and electrical control system.

BACKGROUND OF THE INVENTION

Proposals have been made heretofore for a vertically disposed screw connected to the cab by a nut mating with the screw. All are subject to serious defects and shortcomings. In some designs the screw is rotated by stationary power means mounted at one end of the screw and, in others, the screw remains stationary and a motor mounted on the cab rotates the nut. Examples of such elevators are disclosed in Schnitzer U.S. Pat. No. 1,161,255, Brown U.S. Pat. No. 2,004,060, Brubaker U.S. Pat. No. 2,627,321, Kinsman U.S. Pat. No. 2,857,021, Katz U.S. Pat. No. 3,799,292, MacChesney U.S. Pat. No. 3,215,227, Letz U.S. Pat. No. 3,468,401, Todd U.S. Pat. No. 2,527,897 and Grove U.S. Pat. No. 3,802,290. Such systems have very restricted performance capabilities and lack reliable safeguards against mishaps, flexible control systems, provision for operating the cab at different speeds, safeguards against operating the elevator unless all doors are locked closed, and provision for propelling the cab with pressurized fluid.

SUMMARY OF THE INVENTION

The foregoing and other shortcomings of rotor and screw type elevator systems are avoided by the present invention wherein there is provided two embodiments of a highly versitile hydraulically powered elevator equipped with a fail-safe semi-automatic control system. In each embodiment the steep-pitched screw is suspended from its upper end and is held stationary normally by upper and lower brakes manually releasable in an emergency to permit controlled rotation of the screw and lowering of the cab, the pitch of the threads being selected to permit auto-rotation of either the rotor or the screw relative to the other.

In the first embodiment the rotor interconnects the cab and the screw and is normally locked against rotation by a spring energized brake. This rotor is connected to a motor-pump unit supplied with pressurized fluid and operating as a motor to propel the cab upwardly and functioning as a pump to provide pressurized fluid for downward cab travel. Cab travel is automatically controlled smoothly and in a shockfree manner during deceleration and acceleration in approach zones to floor stations as well as during fast travel between approach zones. In multiple floor installations, stabilizer devices for the screw spaced along the shaft are individually and automatically shifted into and out of stabilizing position as the cab travels along the shaft. The high pressure fluid line to the motor-pump is located within the return fluid line which is maintained flooded from a reservoir at a higher level. Accordingly, should the pressure line of the first embodiment develop a leak or fail for any reason all fluid is confined to the return line and returned to the reservoir. The control system incorporates numerous fail-safe expedients and the fluid system is pressurized only when all doors are closed and the system is otherwise in a safe operating condition. Upon arrival at a desired station all pressurized components are deactivated.

The second embodiment utilizes essentially the same electrical and hydraulic control system as the first embodiment but includes various important different mechanical expedients. A tubular screw is employed which is suspended in a self-aligning thrust bearing at the top of a surrounding tube enclosing both the screw and its rotor. The elongated rotor assembly is provided with rollers bearing against the interior of the support tube and is connected to the elevator cab or other load by brackets projecting through a slot extending lengthwise of the support tube. The steep-pitched screw autorotates when the normally closed brakes at its opposite ends are released. This screw can be driven from either end by a hydraulic motor-pump which, as aforementioned, functions as a motor to drive the screw for upward cab travel and functions as a pump during autorotation of the screw. A governor driven by the screw has a low speed sensing switch which cooperates with the speed control components to assure gradual deceleration of the cab to zero during cab approach to a selected floor level or stop position. The governor also has a high speed sensing switch which serves to limit the rate of cab travel between stations.

Accordingly, it is a primary object of this invention to provide an improved rotor and screw elevator and a unique control system therefor.

Another object of the invention is the provision of a rotor and screw elevator incorporating numerous fail-safe expedients.

Another object of the invention is the provision of a rotor and screw elevator system powered by pressurized fluid.

Another object of the invention is the provision of a rotor and screw elevator system propelled along the screw by a fluid motor-pump unit attached to the cab and operating as a motor for upward travel and as a pump for downward travel.

Another object of the invention is the provision of a rotor and screw elevator system utilizing a suspended screw normally held against rotation by manually releasable means.

Another object of the invention is the provision of a rotor and screw elevator system in which both the rotor and the screw are normally held against rotation by self-setting brakes and wherein either the rotor or the screw will auto-rotate while the other is held against rotation.

Another object of the invention is the provision of an elevator having a cab propelled upwardly by a fluid pressure power means mounted at the cab and wherein the flexible pressure hose to the power means is enclosed within a non-pressurized fluid return line.

Another object of the invention is the provision of a rotor and screw elevator system powered by pressurized fluid only while the cab is in safe travel condition between stations and is depressurized between travel periods.

Another object of the invention is the provision of a rotor and screw elevator system powered by pressurized fluid supplied at different rates by a pair of pumps arranged to drive the cab at high speed between stations but at gradually varying speed while approaching or departing from a station.

Another object of the invention is the provision of a hydraulically powered rotor and screw elevator provided with a control system functioning smoothly and in a shockfree manner to control cab travel during both acceleration and deceleration through approach zones adjacent floor stations and during fast travel between approach zones.

Another object of the invention is the provision of improved decelerator means for an elevator including both mechanical and hydraulic means supplementing one another in decelerating an out of control descending cab.

Another object of the invention is the provision of unique means for stabilizing a screw along which a load is transported and including means responsive to the approach and recession of the load to retract and re-extend the stabilizer relative to the screw.

Another object of the invention is to provide a hydraulically powered load transfer device having automatic means for smoothly and gradually varying the flow of hydraulic fluid to slow the approach of a load to a selected point and for gradually increasing the flow of hydraulic fluid when initiating movement of a load from a static condition.

Another object of the invention is the provision of a hydraulically powered rotor and screw elevator system having governor-controlled automatic means for propelling the cab at high speed between levels and including shockless means for automatically gradually reducing and increasing the speed as the cab approaches and departs from each level.

Another object of the invention is the provision of a rotor and screw elevator system employing a steep-pitched screw in which either the rotor or the screw is driven by a unit selectively operable as a motor during upward cab travel and as a pump during downward cab travel.

Another object of the invention is the provision of a rotor and screw elevator system in which the screw and rotor are housed within and supported from the upper end of a vertically slotted tube embracing substantially the full length of the screw the slot of which accommodates cantilever connections between the rotor and the cab.

Another object of the invention is the provision of a rotor and screw elevator system wherein the screw is embraced by a vertically slotted tube having a cab supported on brackets extending through the slot and connected to the rotor and wherein the rotor is equipped with rollers in contact with the interior of the slotted tube.

Another object of the invention is the provision of a rotor and screw elevator having a main frame comprising a slotted tube supporting the screw in suspension and providing lateral support for the screw, the rotor and a cab connected to the rotor by brackets projecting through the slot along the tube.

Another object of the invention is the provision of a steep-pitched rotor and screw elevator system in which the screw is rotated in one direction by a hydraulic motor and auto-rotates in the other direction under gravity forces and including means responsive to the rotational speed of the screw to aid in gradually decelerating downward travel while approaching a selected stop position.

Another object of the invention is the provision of a screw and rotor elevator system equipped with a fail-safe control including governor actuated low and high speed sensing means operable to regulate cab speed during approach to a selected station and to limit the rate of high speed travel between stations.

Another object of the invention is the provision of a hydraulically powered rotor and screw elevator system having automatically controlled hydraulic door operating components.

Another object of the invention is the provision of a hydraulically powered rotor and screw elevator system having dual pumps one of which supplies pressurized fluid for auxiliary components and to initiate preliminary high speed upward travel and the other of which supplements the first pump in supplying fluid for high speed upward travel.

Another object of the invention is the provision of a hydraulically powered rotor and screw elevator system which is fool-proof and fail-safe mechanically, electrically and hydraulically.

These and other more specific objects will appear upon reading the following specification and claims and upon considering in connection therewith the attached drawing to which they relate. Referring now to the drawing in which a first preferred embodiment of the invention is illustrated in FIGS. 1 to 15:

FIG. 4 is a cross-sectional view taken along line 4—4 on FIG. 1 which is a fragmentary side elevational view of the low and high speed governor shown and driven by a belt encircling the motor;

FIG. 5 is a top plan view of the main frame and the manually releasable brake for the screw with parts broken away to show structural details;

Figure 15A:
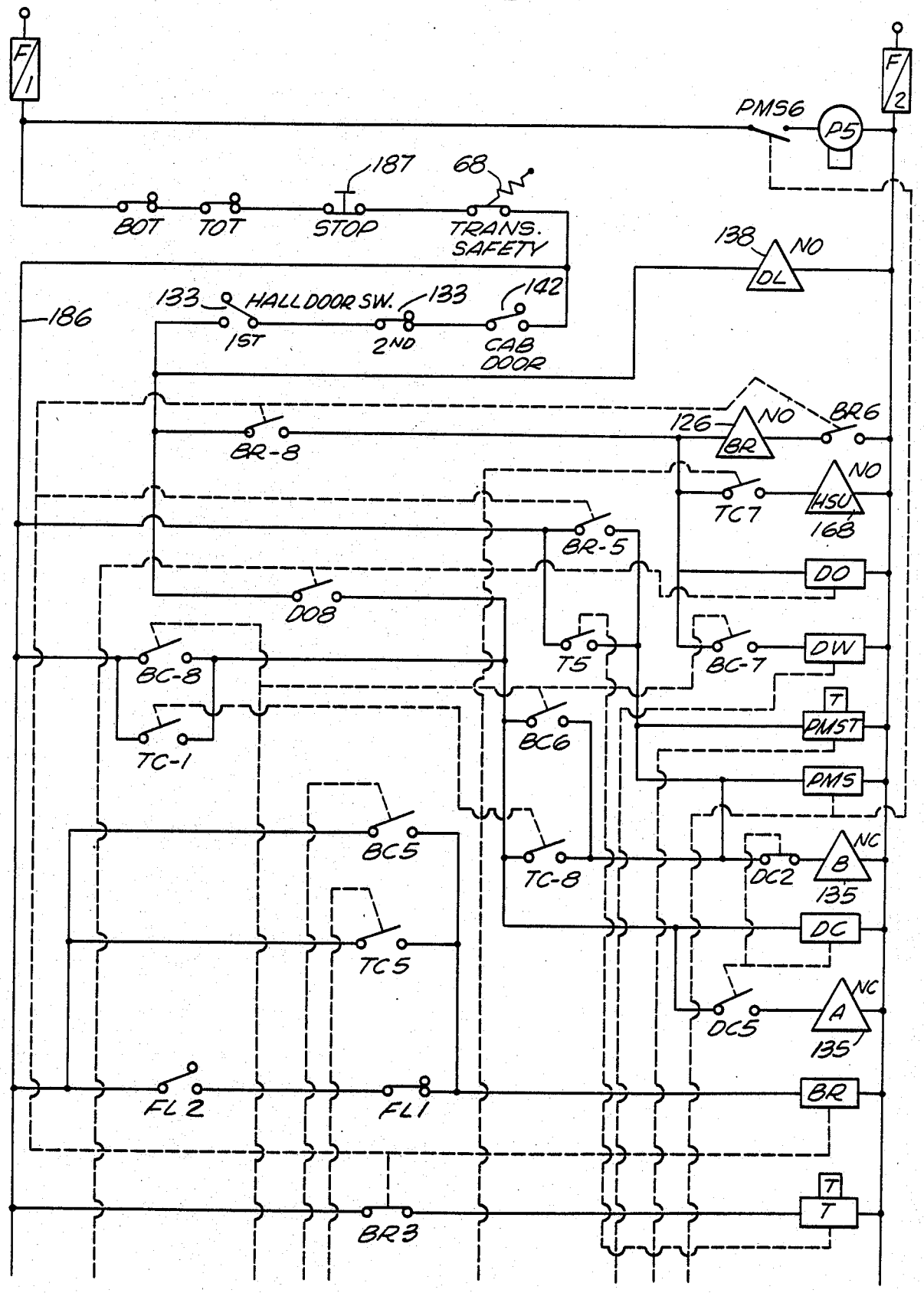
Figure 15B:
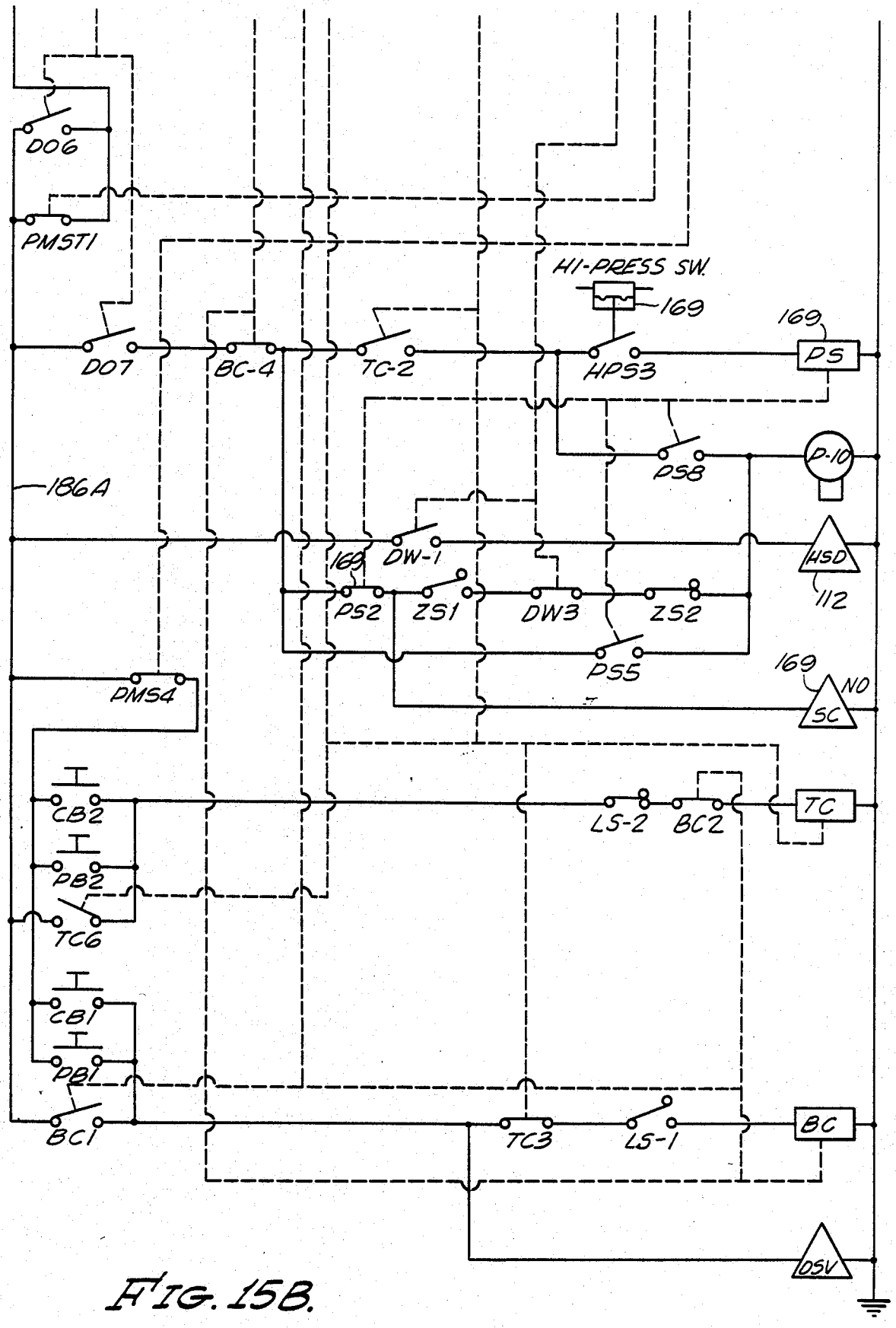

FIGS. 15A and 15B, taken together, comprise a schematic of the electrical control circuitry in normal de-energized condition with the cab stopped at the ground floor with the door open.

Figures 16, 17:
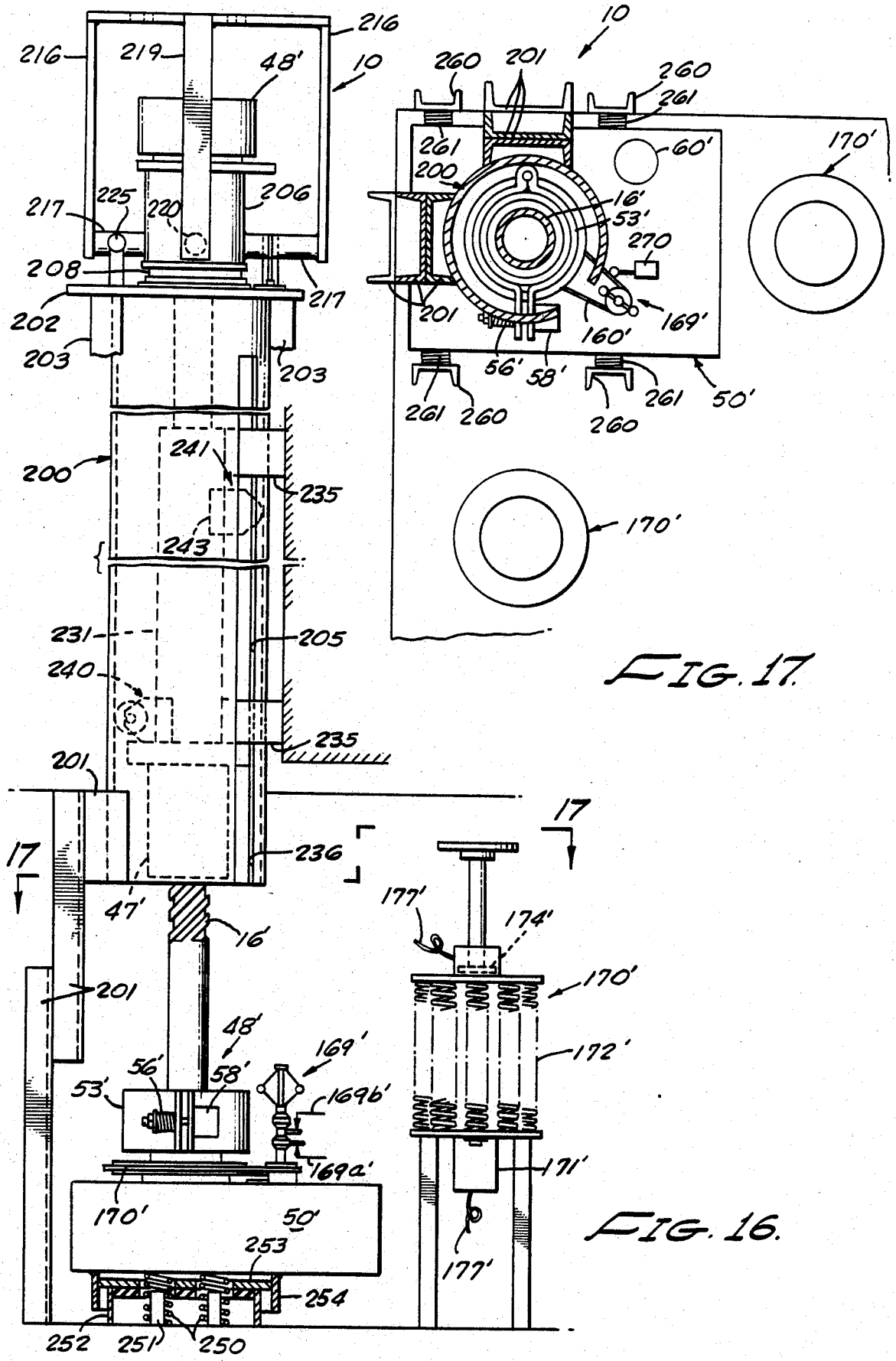
Figure 18:
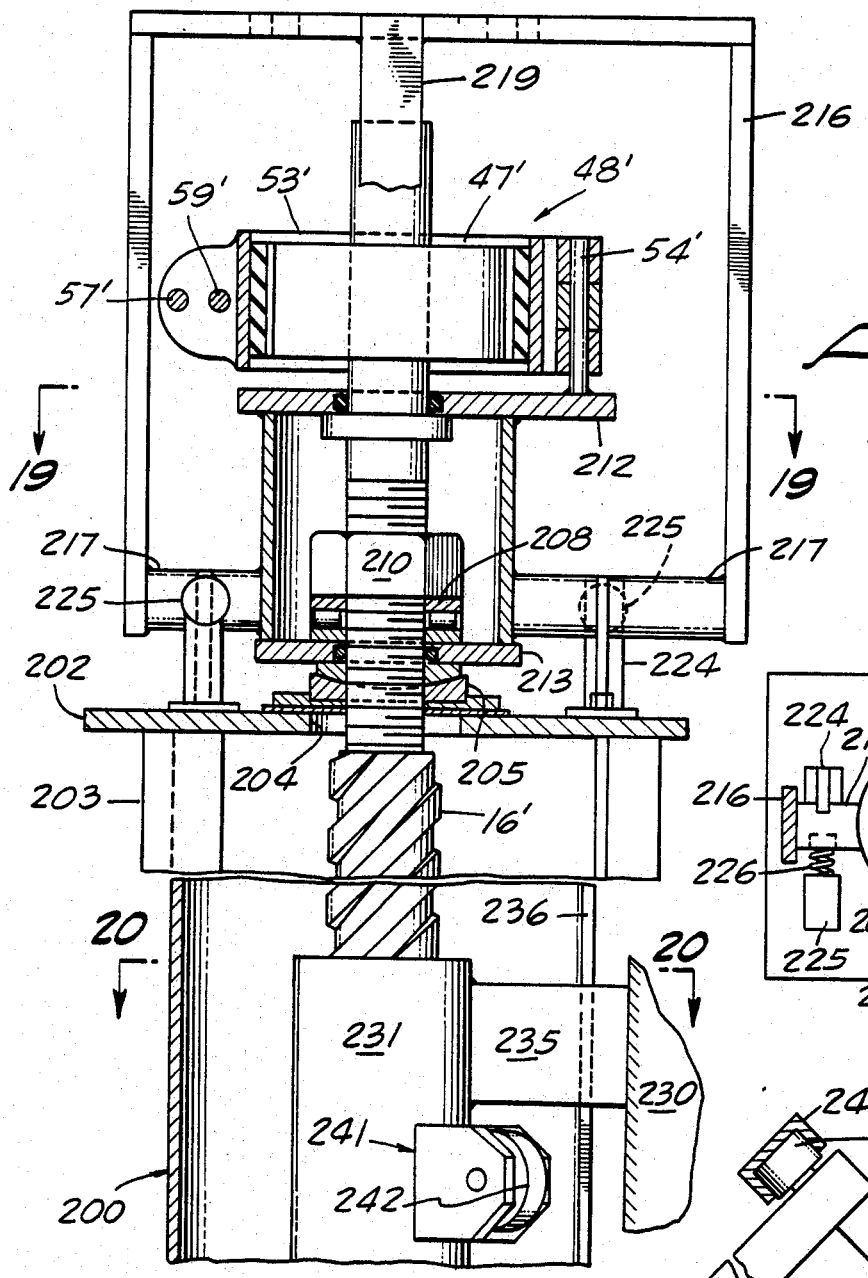
Figure 19:
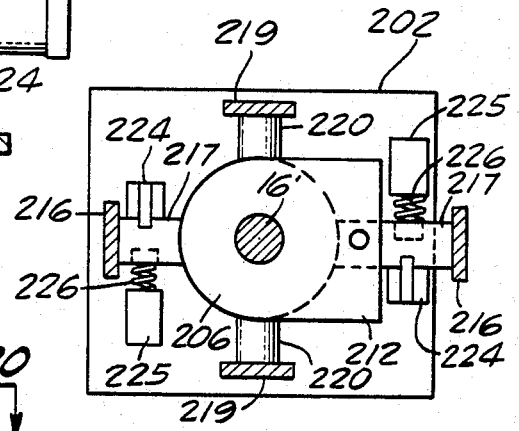
Figure 20:
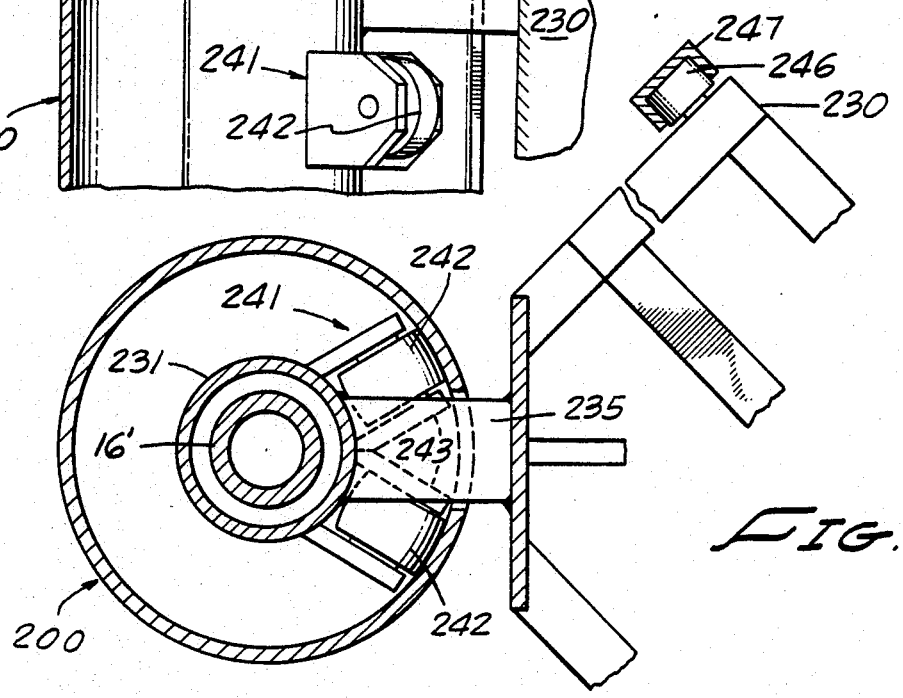
Figure 21:
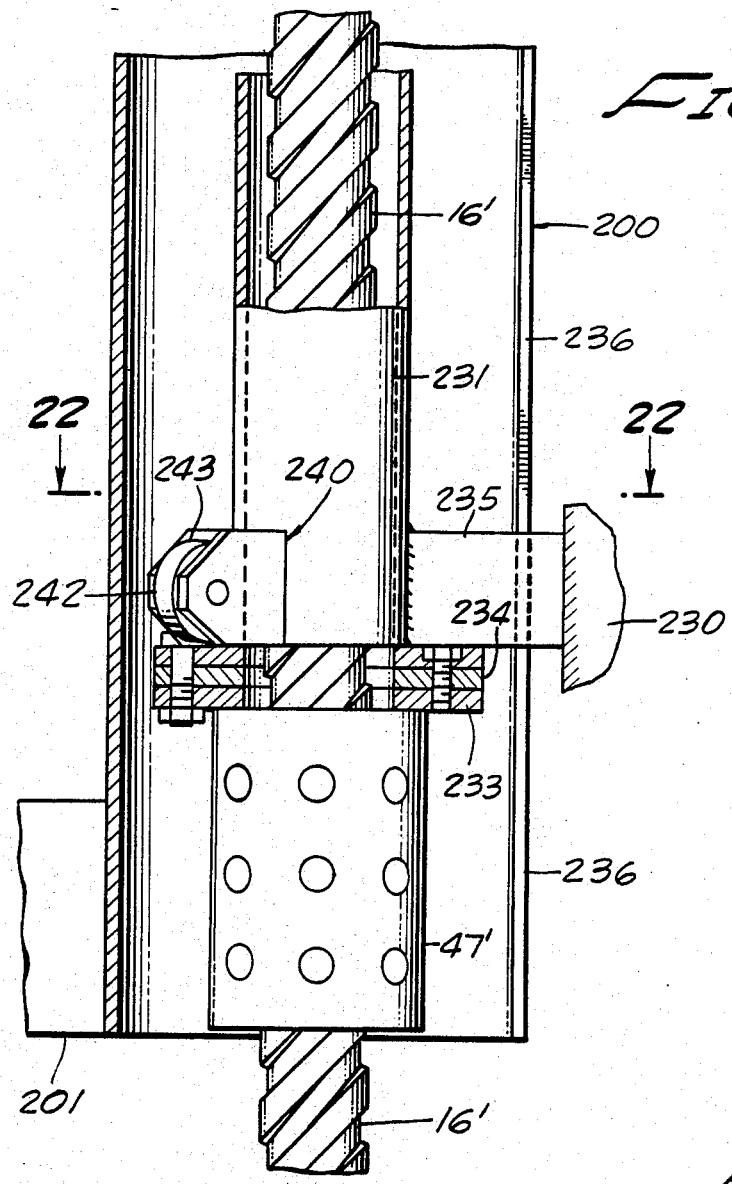
Figure 22:
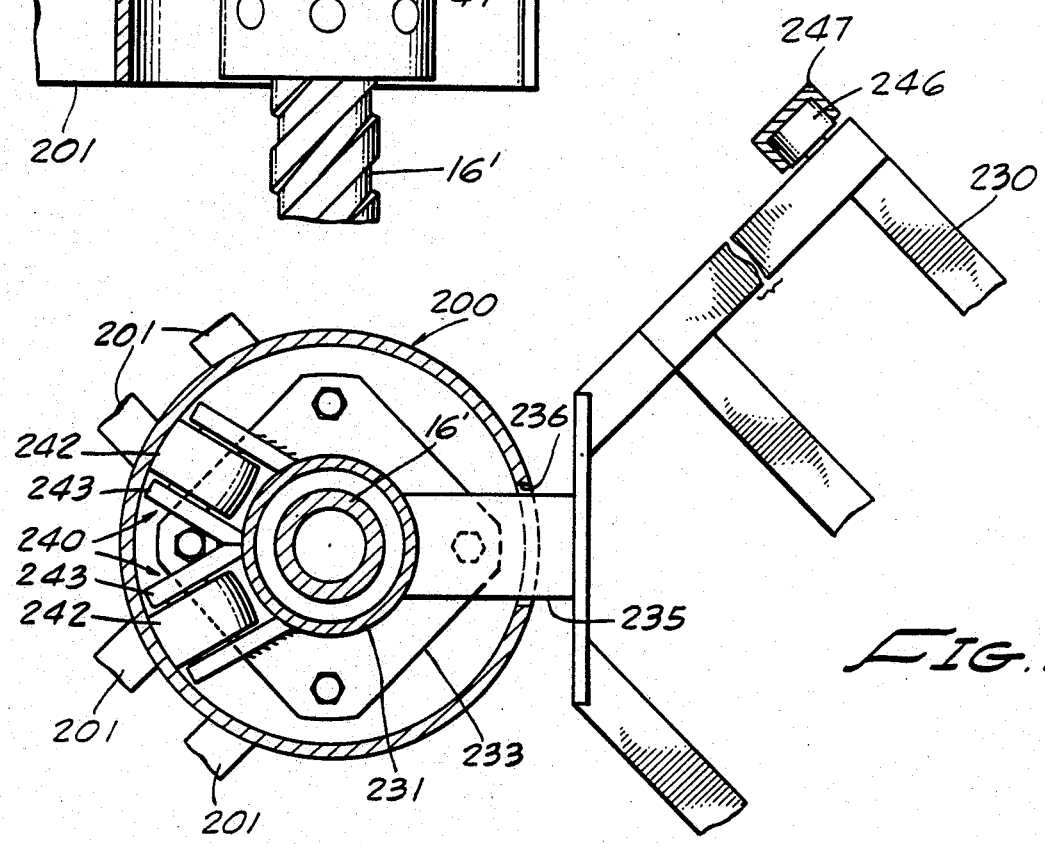

FIG. 16 is a side elevational view of a second preferred embodiment of the invention with a portion only of the cab shown at the lowermost operating position thereof;

FIG. 17 is a cross sectional view taken along line 17—17 on FIG. 16;

FIG. 18 is an enlarged vertical cross sectional view through the upper end of the screw axis as viewed in FIG. 16;

FIG. 19 is a cross sectional view along line 19—19 on FIG. 18;

FIG. 20 is a fragmentary cross sectional view taken along line 20—20 on FIG. 18;

FIG. 21 is an enlarged fragmentary sectional view of the rotor subassembly and adjacent components appearing in the midlength portion of FIG. 16; and FIG. 22 is an enlarged fragmentary cross sectional view similar to FIG. 20 and taken generally along line 22—22 on FIG. 21.

FIRST EMBODIMENT GENERALLY

Referring to FIGS. 1 to 15*b* illustrating first preferred embodiment and more particularly to FIG. 1-5, there is shown a steep-pitched, dual lead rotor and screw elevator system having a cab 10 equipped with rollers 11 (FIGS. 1 and 4), confining the cab to vertical movement along guideways 12, 12 (FIG. 4) of a vertically disposed main frame 13 extending for the full height of the elevator shaft. The main frame includes cross braces including a screw hanger cross brace 14 (FIG. 1) and U-shaped cross-braces 14', 14' (FIGS. 1 and 6-8) at appropriate intervals along the length of the main frame.

Cab 10 travels lengthwise of the shaft along a steep pitch screw 16 suspended from a self-aligning thrust bearing 17 supported on a hanger cross-brace at the top of the main frame. Bearing 17 is enclosed in a housing 18. As is made clear by FIG. 2, the upper end of screw 16 is equipped with a load transfer nut 19 resting against the upper side of thrust bearing 17. Screw 16 has a dual lead thread having a steep pitch of about 23° relative to the screw axis.

Screw 16 projects above load bearing nut 19 and is keyed to the drum 20 of a powerful brake (FIG. 1) normally clutched by two shoe sections 22, 23 each with cork lining firmly bonded to the steel backs. The details of this normally firmly set spring brake are best shown in FIG. 5. Each of the brake shoes 22, 23 has a projecting ear 24 held pressed against the diagonally related faces of main frame members 13, 13 by the shock springs 26, 26 when screw is under no torque load. One pair of adjacent ends of shoes 22, 23 is loosely connected by a fastener 25 and the diagonally opposed ends are urged toward one another to clamp drum 20 by a powerful compression spring 27 encircling an adjustable fastener 28 having a threaded shank welded to shoe 22.

Normally spring 27 holds the brake shoes set against rotor 26 keyed to the elevator propelling screw 16. However, in an emergency the brake can be manually and controllably released by an operating lever 29 pivoted by pin 30 to brake shoe 23 and having a tang 31 engageable with the adjacent end of brake shoe 22 when lever 29 is pivoted counter-clockwise. This pries the two brake shoes apart and away from rotor 20 thereby permitting screw 16 to auto-rotate relative to its rotor 47 provided a normally closed coupling 34 at the lower end of screw 16, to be described presently, has been released.

Figure 1:
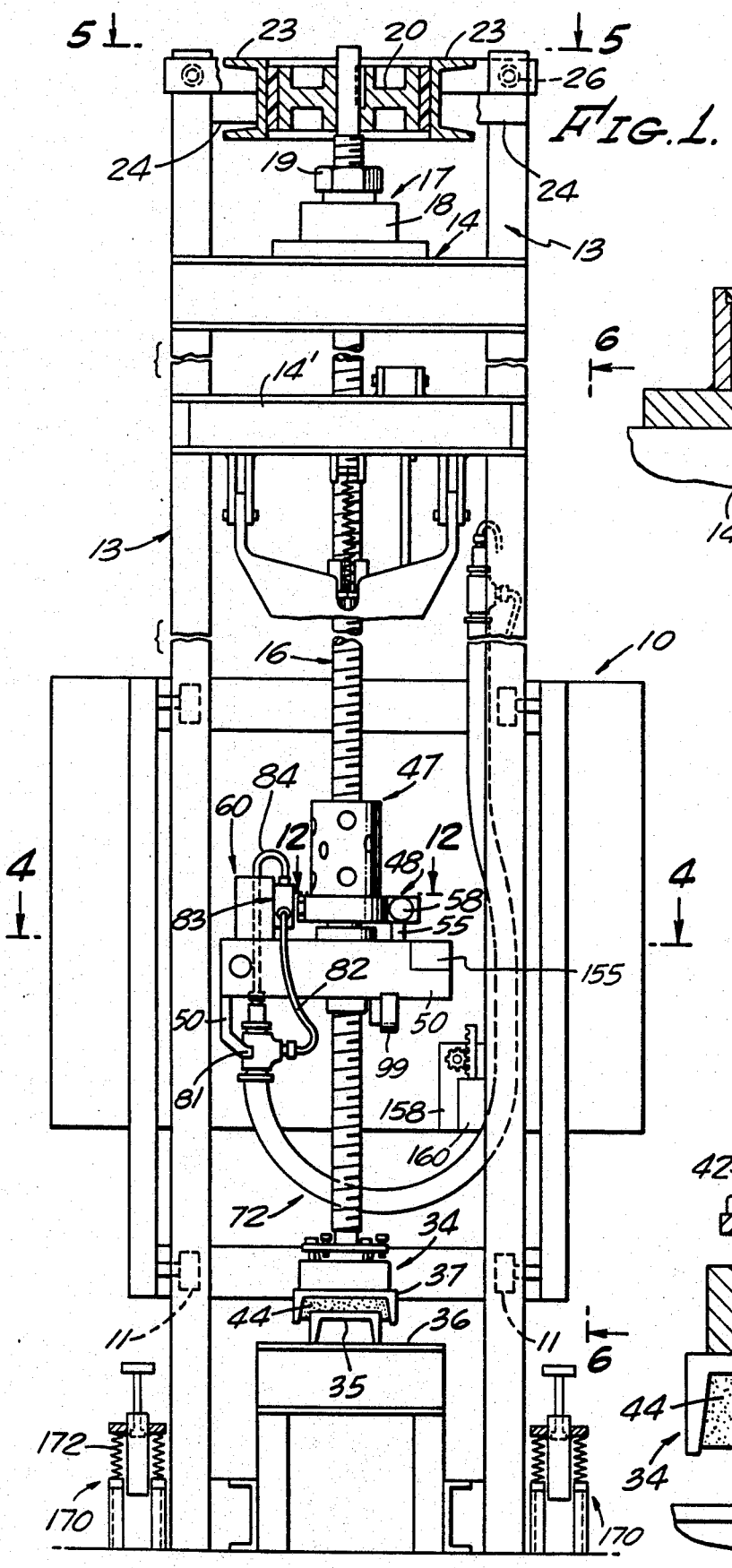
FIG. 1 is an elevational view of an illustrative embodiment of the invention but showing the cab and the upper and lower portions only of the main frame and with portions broken away to show constructional details.
Figure 2:
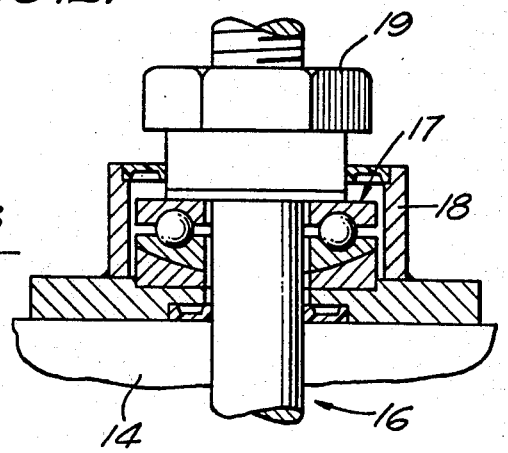
FIG. 2 is a cross-sectional view on an enlarged scale of the thrust bearing for the screw.
Figure 3:
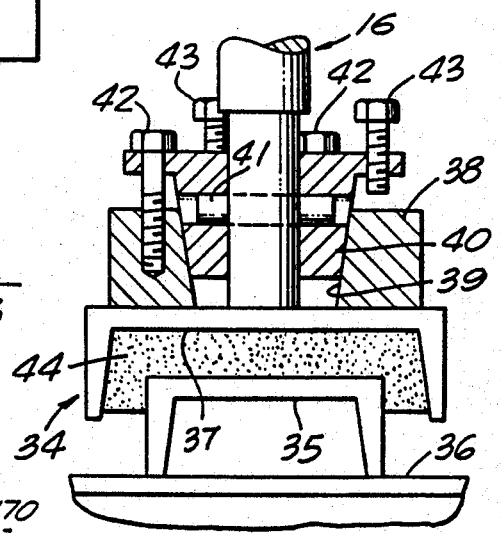
FIG. 3 is a cross-sectional view on an enlarged scale of the floating joint and manually releasable coupling for the lower end of the screw.

The combined floating bearing and coupling 34 at the lower end of screw 16 is best shown in FIGS. 1-3. This sub-assembly includes an inverted channel member 35 or the like supported on an underlying stationary pedestal 36 at the base of main frame 13. A second and larger inverted channel member 37 is spaced above and partially internests with channel 35. Welded to the top side of the web of channel member 37 is an outer coupling ring 38 having a conical bore 39 mating with the conical outer surface of an inner coupling ring 40 keyed to the lower end of screw 16 as by pin 41. Normally, rings 38 and 40 are clamped firmly seated together by a plurality of cap screws 42. However, the coupling rings may be disengaged by removing cap screw 42 and lowering a plurality of cap screws 43 to pry rings 38 and 40 axially apart.

From the foregoing it will be recognized that so long as cap screws 42 are tightened as shown in FIG. 3, the two coupling rings are clamped together and the lower end of screw 16 is held against rotation by the engagement of the side flanges of channel member 37 with channel member 35. Slight rotary movement of the screw is possible by reason of the limited radial spacing between the flanges of channel members 35, 37 which space is occupied by a rubber cushion 44. This radial spacing and cushion 44 permit limited lateral movement of screw 16 and the proper functioning of the self-aligning bearing 17 at its upper end. The floating bearing 34 also permits limited lateral movement of the cab without imposing bending stresses on the screw 16.

The floating bearing and coupling 34 also serves a highly important safety function in that it holds screw 16 firmly anchored against rotation if either the upper bearing 17 or brake assembly shown in FIG. 5 should fail, or if the screw itself should break above the cab. In this event the screw becomes loaded in compression rather than in tension. The cab can still be operated downwardly safely because members 35 and 37 nest substantially together and cooperate with coupling rings 38 and 40 in holding the screw against rotation.

Figure 12:
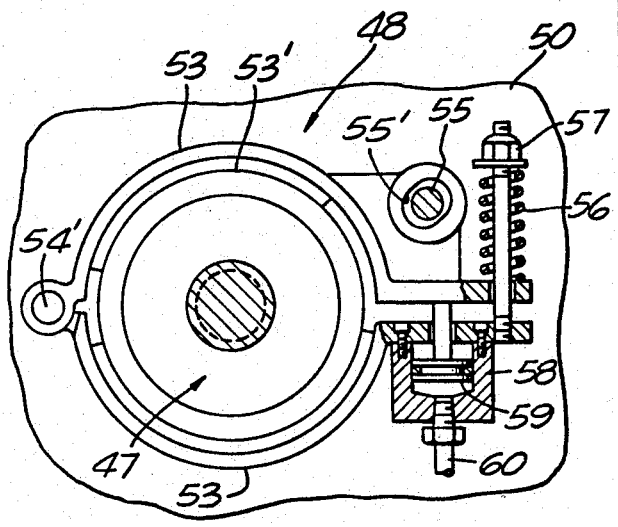
FIG. 12 is a fragmentary sectional view taken along line 12—12 on FIG. 1 showing details of the rotor brake.

Referring now more particularly to FIGS. 1 and 12, rolling nut or rotor 47 and the associated self-setting brake sub-assembly 48 will be described. It will be understood that rotor 47 may be of any well known type but preferably incorporates the principles of the aforementioned U.S. Pat. No. 4,272,296. The tubular main body is provided with a plurality of nonradial rollers mounted in anti-friction bearings and having their tapered inner ends in rolling contact with the helical groove of screw 16.

Brake 48 (FIGS. 1 and 12) embraces a brake drum 53' fixed to the lower end of rotor 47 having a threaded bore mating with the threads of screw 16 and suitably mounted coaxially of the lower end of rotor 47. This rotor and brake drum assembly is operatively connected to the transmission housing 50 for the rotor by a thrust bearing assembly 49. Housing 50 is connected to the elevator cab 10 by a bracket 51 best shown in FIG. 4.

FIG. 12 shows further details of brake 48 which includes a pair of brake shoes 53 pivoted together by a hinge pin 54 preferably having its lower end secured to the transmission housing 50. The diametrically opposite side of one of the shoes 53 is anchored to transmission housing 50 by a shouldered pin 55 extending loosely through a slightly elongated opening 55' the longer axis of which passes through the center of screw 16 and permits free operation of the brakes without binding for reasons readily apparent to persons skilled in the operation of this type of brake. Owing to the steep pitch of screw 16, both the screw and rotor 47 will autorotate relative to one another when not restrained by brake 48 or by other means. Accordingly, the release of brake 48 permits the elevator cab to travel downwardly as rotor 47 freely rotates counterclockwise about screw 16 until brake 48 resets under the automatic control of the speed control system to be described presently.

Normally the brake shoes 53 are held closed against brake drum 53' by a strong compression spring 56 embracing the shank of an adjustable fastener 57 secured to the end of one of the brake shoes and extending freely through an opening in the other in the manner shown in FIG. 12. A hydraulic cylinder 58 mounted on one of the brake shoes has the stem of its piston 59 bearing against the other brake shoe. Pressurized fluid supplied by a conduit 60' (FIGS. 12, 14) opens into cylinder 58.

Figure 14:
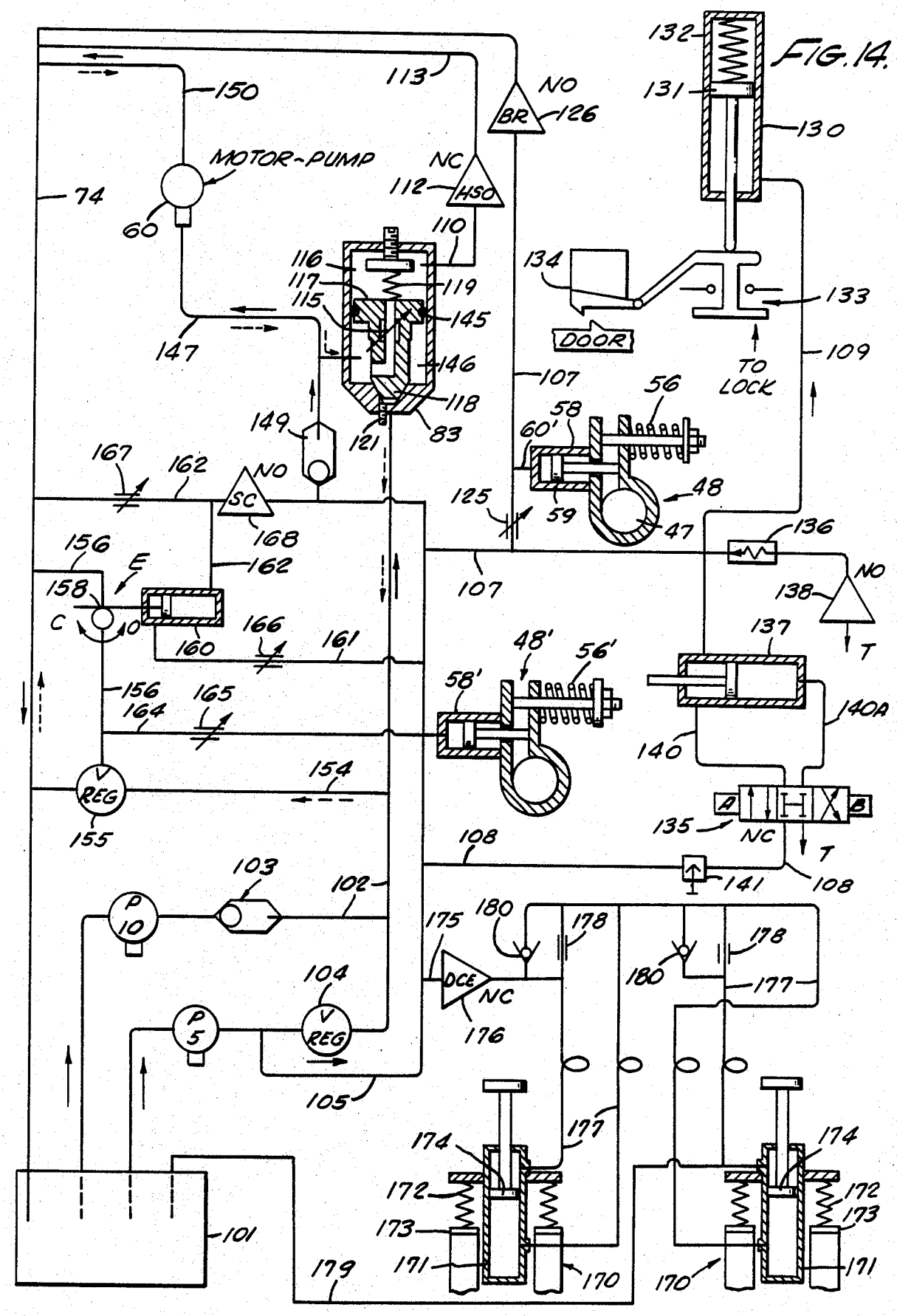
FIG. 14 is a schematic showing of the fluid circuit components.

As will be described in detail in describing the operation of the elevator and its control system, whenever there is a call for elevator operation, the smaller one P5 of the pumps start to operate and cooperates with a pressure regulator 104 to maintain a pressure of about 350 psi in line 105 (FIG. 14) to operate certain auxiliaries including brake 48 for rotor 47, the cab door lock 130 and the door cylinder 140 (FIG. 14). However, unless cylinder 58 is pressurized, spring 56 holds brake 48 securely clamped and set against drum 53' attached to rotor 47, thereby normally locking rotor 47 and the cab motionless irrespective of whether the hydraulic components are pressurized. In fact, except when the elevator system is in actual use, the hydraulic system is fully or substantially depressurized.

The power drive for rotor 47 for upward cab travel comprises a hydraulic motor-pump unit 60 mounted on the transmission housing 50 with its shaft extending vertically into the interior of this housing. This shaft drives a pinion 61 coupled by helting such as a chain link belt 62 (FIG. 4), with a sprocket 63 keyed to a tubular spindle extending downwardly from rotor 47 through brake drum 53' and into housing 50.

Unit 60 is aptly designated as a "motor-pump" since, during cab descent, rotor 47 auto-rotates about screw 16 and drives unit 60 as a pump; and during upward cab travel, unit 60 acts as a motor to rotate rotor 47 upwardly along screw 16. Accordingly, it will be understood that the expression "motor-pump" wherever used in this specificaiton and in the claims has reference specifically to unit 60 which functions at times as a motor and at times as a pump. When acting as a motor, unit 60 is supplied with pressurized fluid by one or both of the pumps P5 and P10. When acting as a pump, unit 60 pumps fluid in the opposite direction to operate the speed control components as will be explained presently.

An important feature of the power transmission assembly is the provision of a safety device safeguarding against migration of the belt laterally off the sprockets and for deactivating the elevator if the drive chain 62 wears beyond a highly safe condition. This device comprises an idler roller 65 mounted on the outer end of an arm 66 pivotally supported at 67 and suitably spring-biased against belt 62 to maintain a predetermined pressure such as 100 psi on the slack run of the belt. The V-shaped supporting arm 66 for the idler roller is operatively connected to a normally closed switch 68 connected to the main electrical power supply for the control system. So long as chain 62 is in safe operating condition and properly positioned on the sprockets switch 68 remains closed. However, should the chain creep from the sprockets or become sufficiently worn to pose a risk the unsafe condition is sensed by the safety sensing roller 65 whereupon the biasing spring opens switch 68 and cuts off all electrical power to the elevator until such time as the chain has been replaced.

Figure 10:
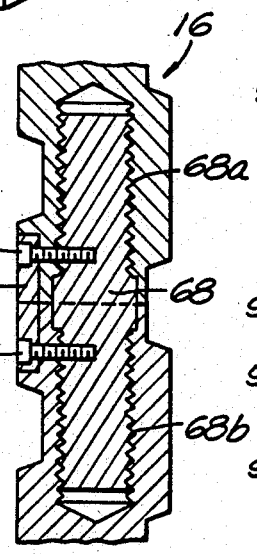
FIG. 10 is a cross-sectional view on an enlarged scale taken along line 10—10 on FIG. 7 and showing the differential threaded coupling inter-connecting adjacent sections of the screw.

Referring to FIG. 10, there is shown a differential threaded coupling interconnecting the adjacent ends of screw 16 when installed in shafts exceeding the length of a single section of the screw. This coupling comprises a member 68 the opposite ends of which have threads **68*a* and 68*b* of different pitch mating with threaded wells axially of the adjacent ends of the screw sections. The coupling member 68 is assembled by trial and error into the threaded wells by slightly different distances until an assembly is achieved in which the helical thread along the exterior of the screw sections mate precisely with one another when the screw ends abut firmly with sufficient torque to exceed the maximum torque input of rotor 47. This assembly position having been determined, a key slot is milled, threaded bores for cap screws 69 are constructed in the bottom of the key slot and a locking key 70 is installed in the slot to lock the parts against disassembly by reverse torque applied to adjacent sections of screw 16**.

Figure 11:
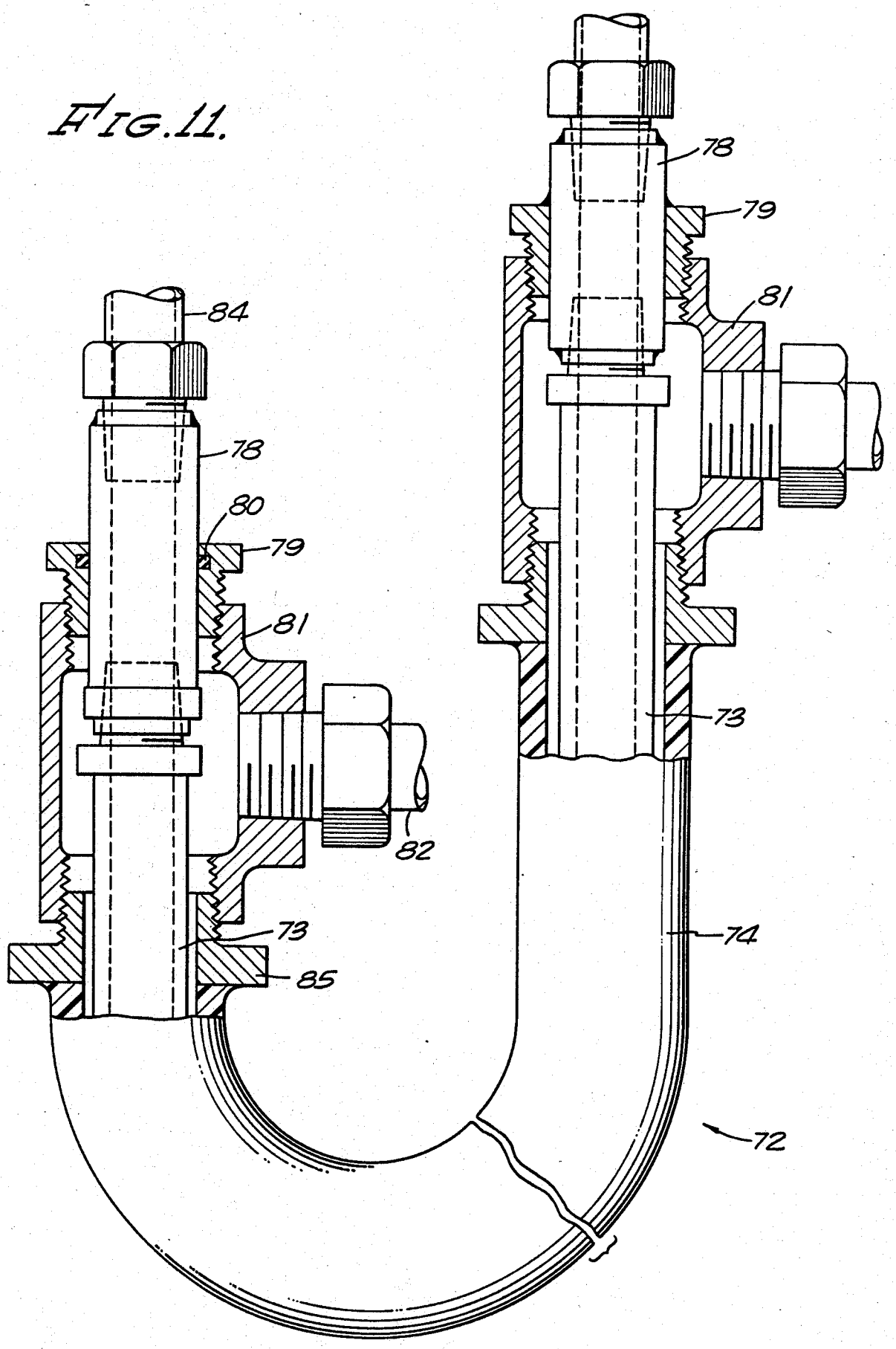
FIG. 11 is an elevational view of the fail-safe fluid hoses interconnecting the cab and the fluid source.

Another important safety feature of the invention comprises a fail-safe flexible hose assembly designated generally 72 (FIGS. 1 and 11). This hose assembly 72 comprises an inner hose 73 for pressurized fluid and a surrounding outer hose 74 for normally unpressurized fluid returning to the fluid reservoir 101. Assurance is thereby provided that, should the pressurized hose 73 leak or rupture, the escaping fluid will be retained within hose 74 and returned to reservoir 101. The inlet end of assembly 72 is suitably attached to the main frame as indicated at 75 and the other end of the assembly is suitably anchored to the transmission housing 50. It is desirable that provision be made for relative axial movement of hoses 73, 74. As herein shown, this comprises a smoothly finished tube 78 having sliding engagement with a ushing 79 provided with a fluid seal 80 and mounted in one end of a T-fitting 81. The other end of the T-fitting is coupled to the return hose 74 as by a threaded fitting 85 and its threaded side opening is connected by a conduit 82 (FIGS. 1 and 11) to the main control valve 83 attached to the side of motor-pump unit 60. Valve 83 comprises a pilot operated sequence valve of any suitable construction such as a Vickers Model The significant details of this valve will be described in greater detail presently. Conduit 84 conducts pressurized fluid from hose 73 to valve 83 and thence to the motor-pump 60 on which valve 83 is mounted. Fittings **78*a*, 79*a* and 81*a* similar to those just described are also provided at the other end of hose assembly 72 except that bushing 79*a* is welded to tube 78*a*. These fittings serve to conduct pressurized fluid into the inlet and of hose 73 and to return unpressurized fluid back to the reservoir 101**.

Figure 8:
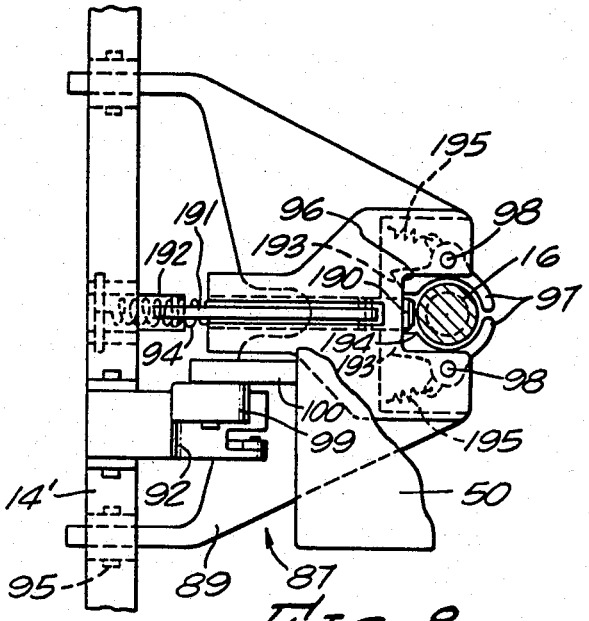
FIG. 8 is a fragmentary cross-sectional view through the screw looking downwardly on an extended stabilizer.

Desirably, if the elevator is designed to service several floors, it is equipped with one or more stabilizer units spaced along screw 16 and serving to provide lateral and vibration-snubbing support therefor. Suitable stabilizers, designated generally 87, will now be described with reference to FIGS. 6–9. These stabilizers are pivotally mounted on the U-shaped cross braces 14' supported generally in a horizontal plane with the ends of their legs welded to main frame 13. Each stabilizer has a generally V-shaped main body 89 having its legs pivoted on pins 95 carried by brackets 90 welded to the underside of cross braces 14'. The stabilizers are pivotable through an arc of about 90° by a toggle linkage comprising a link 91 connected to one arm of an L-shaped camming link 92. Link 92 is pivoted at 93 to a bracket welded to the upper side of cross brace 14'. A tension toggle spring 94 has one end anchored to bracket 90 and its other end connected to stabilizer 87 in such manner that when the stabilizer is retracted the center line of spring 94 lies to the left of pitot pin 95 to lock the stabilizer retracted as shown in dot and dash line in FIG. 7. However, when the camming link 92 is pivoted counterclockwise by upward travel of cab 10 therepast thereby pivoting the stabilizer to its extended position shown in full lines in FIG. 7, spring 94 acts to hold the stabilizer firmly extended as is shown in FIGS. 7 and 8.

Figure 9:
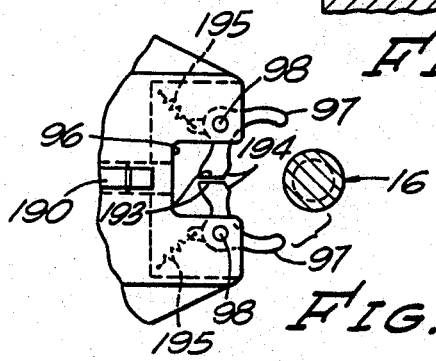
FIG. 9 is a fragmentary cross-sectional view showing the stabilizer in proximity to the screw with its jaws open in readiness to embrace the screw.

The outer end of each stabilizer 89 has a notch 96 to receive and straddle the screw 16 and, for this purpose, is provided with a pair of arcuate jaws 97 held pivoted to stabilizer 89 by pins 98 and biased to their extended position shown in FIG. 9 by compression toggle springs 195 anchored to the main body of the stabilizer 89. Springs 195 are mounted between stabilizer 89 and each of the jaws 97 as shown in FIG. 9 in such manner that the center line of each spring passes across the axis of the associated pivot pin 98 as jaws 97 open or close and, in cooperation with stops for the jaws, serve to hold the jaws 97 open as shown in FIG. 9, or closed about screw 16 as shown in FIG. 8.

Figure 6:
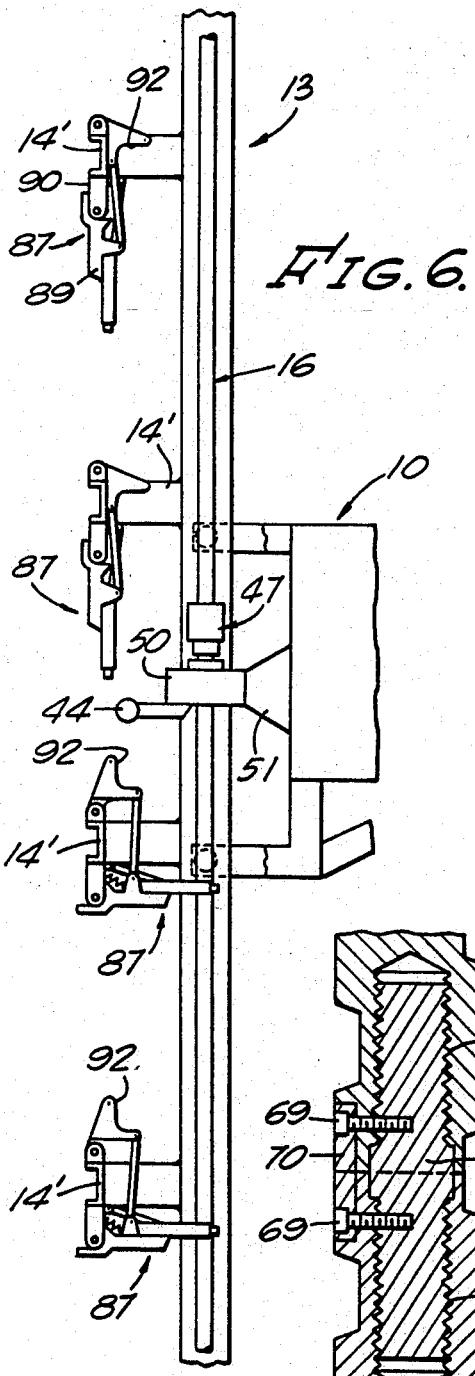
FIG. 6 is a fragmentary side elevational view of the main frame showing several of the screw stabilizers the upper two of which are shown retracted and the lower two of which are shown extended to stabilize the screw.
Figure 7:
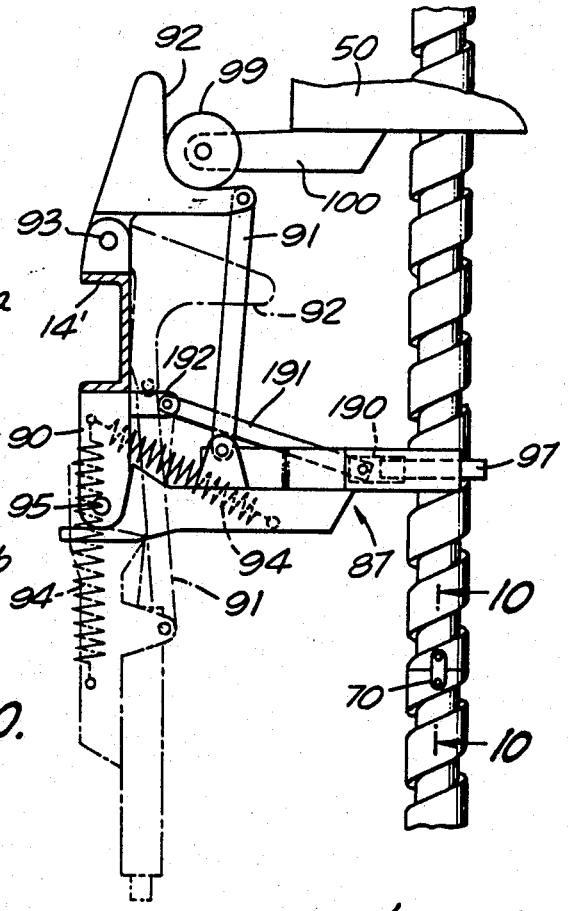
FIG. 7 is a fragmentary elevational view showing a single screw stabilizer extended in full lines and shifted to its retracted position in dot and dash lines.

Suitable operating means for stabilizers 87 comprise a roller 99 mounted on the outer end of a bracket 100 secured to some part of the cab 10 such as the transmission housing 50 (FIG. 6). As the cab moves upwardly along the screw, roller 99 will engage the notch of camming link 92 and pivot the adjacent fully retracted stabilizers 89 upwardly to its extended horizontal position. Initially, jaws 97 of this stabilizer are fully open but as the stabilizer approaches its horizontal position jaws 97 engage screw 16 and pivot inwardly toward one another to loosely embrace the screw and are held firmly and positively in this position by the toggle springs 195 and spring 94. This locking pin is slidably supported in a tubular passage formed in the main body of stabilizer 89 and opening into the notch 96 supporting jaws 97. The locking pin is pivotally connected to an operating rod 191 pivotally anchored to a bracket 192 mounted on bracket 90 as is best shown in FIG. 8. When the stabilizer is elevated to its extended or horizontal postion, locking pin 191 is positioned between the adjacent ends of jaws 97 and is effective to lock these jaws positively closed about screw 16.

The stabilizer is shifted between its two stable positions by roller 99 mounted on arm 100 of the cab as the car moves past the stabilizer. For example, if the stabilizer is retracted as the cab engages the socket in the L-shaped link 92 and pivots it upwardly as the attached link 91 pivots the main body 89 of the stabilizer upwardly to its extended horizontal position. As the stabilizer approaches screw 16, jaws 97 engage the screw and pivot into closed position about screw 16. While doing so, rod 191 extends locking pin 190 between the adjacent ends of jaws 97 as shown in FIG. 8 to lock these jaws closed about screw 16. As the jaws approach their screw embracing position, the advance end of the locking pin engages the pilot surfaces 193, 193 of the jaws and holds the jaws partially open until the pin has been extended beyond the junction of surfaces 193, 194. Tension springs 195 then cooperate with the locking pin 190 in holding the jaws positively closed about screw 16.

All stabilizers 87 below the cab are closed and serve to steady the screw during travel of the cab above all extended stabilizers. During downward movement, roller 99 operates the stabilizers. During downward movement, roller 99 operates the stabilizers to their retracted position as it engages the socket of link 92 and pivots the stabilizer assembly counterclockwise to its retracted position wherein the centerline of spring 94 lies slightly to the left of the axis of the stabilizer pivot pin 95 (FIG. 7) As the downward pivot movement starts, rod 191 retracts locking pin 190 thereby permitting springs 195 to pivot jaws 97 to their open position and to hold them open until the stabilizer is next returned toward its extended horizontal position.

CONTROL SYSTEM

The elevator control system is schematically illustrated in FIGS. 14, 15A and 15B respectively illustrating the hydraulically controlled components and the electrical control components. The following legends and descriptions of the symbols identifying these components will be used in describing the components and their functions. For the most part the symbols are listed in the order in which they appear in the several figures:

| | |
|---|---|
| F1, F2 | Line Fuses |
| BOT | Bottom over travel safety switch |
| TOT | Top over travel safety switch |
| DO | Door relay |
| DW | Down relay |
| DCE | Decelerator solenoid valve |
| PMS | Pump motor starter relay |
| PMST | Start-time delay-operate (Timer) |
| T | Time delay operate pump stop (timer) |
| GL | Low speed governor relay |
| GH | High speed governor relay |
| BR | Brake relay |
| TCA | Top call relays |
| CB-1 & CB-2 | Cab call buttons-floors 1 & 2 |
| BCA | Bottom call relay |
| PB1 & PB2 | Public or hall cab call buttons - floors 1 and 2 |
| P5 | Small fluid pump starter |
| P10 | Large fluid pump starter |
| SC | Speed control solenoid valve |
| HSD | High speed down solenoid valve |
| Triangle Symbol | Solenoid operated valve |
| Rectangle Symbol | Relay |
| Circle Symbol | Fluid pump |
| V. REG. | Unloading valve and pressure regulator |
| N.O. | Normally open component |
| N.C. | Normally closed component |
| LS-1 | Limit switch first floor |
| LS-2 | Limit switch second floor |
| FL-1 | First floor switch |
| FL-2 | Floor level second floor |
| ZS-2 | Zone switch second floor |

All switches and relay contacts in FIGS. 15A and 15B are shown in their normal position with the elevator stopped at the first floor level. The dotted lines leading from each relay to its respective contacts represent the operating means to change the position of these contacts when the relay is energized or de-energized. In general, the relay contacts are identified by the relay symbol plus a numeral representing a particular contact of that relay. Each solenoid operated valve is marked NO or NC to indicate that it is normally open or normally closed.

It is also pointed out that the electrical schematic shows the necessary circuitry to operate an elevator between the first and second floor, there being one set of hall and cab buttons in the lower left hand corner of the schematic one of which can be closed to initiate down travel from the second floor to the first floor and a second set of hall and cab buttons immediately thereabove employed to intiate an up cycle. The switches marked PB1 and PB2 will be understood as located in the hall of the first and second floors, respectively, and the buttons marked CB1 and CB2 being located in the cab and operable by a passenger on board the elevator.

Figure 13:
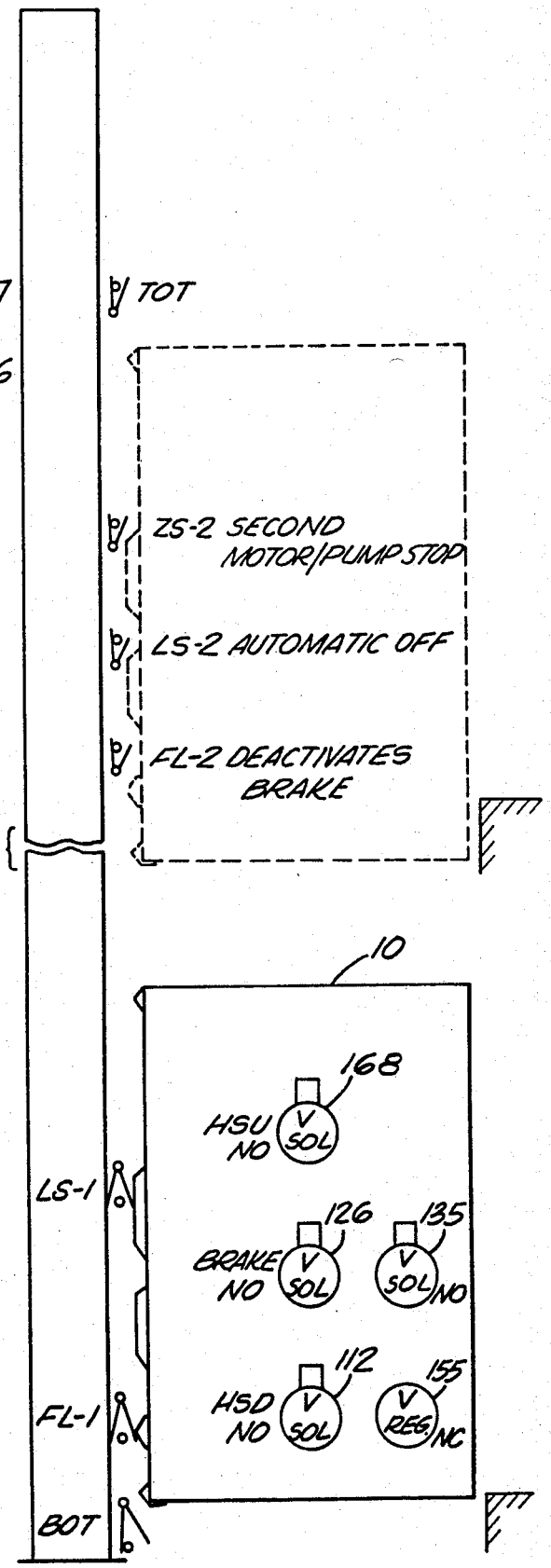
FIG. 13 is a diagrammatic representation of the elevator cab and of the control components controlled by movement of the cab, the full lines showing the condition of certain switches with the cab stopped at ground floor and the dotted line showing representing the cab approaching the second floor.

The diagrammatic showing in FIG. 13 represents the elevator shaft and the cam operated switches mounted along the main frame and operated by cams located on the cab.

It will be understood that the cam operated switches shown in FIG. 13 are offset laterally to lie in different vertical planes so that each switch is operated only by its own cam. The solenoid valve symbols opposite the various switches indicate that these valves are functionally associated with the operation of the switch immediately to the left of each pair of valve symbols. The dotted line representation of the elevator at a higher level indicates the condition of the switches as the cab is approaching the second floor.

THE HYDRAULIC SYSTEM

The hydraulic schematic in FIG. 14 represents the hydraulic components and the plumbing connecting the same to the hydraulic fluid reservoir 101. For convenience, this reservoir is shown in the lower left hand corner but it preferably is so located that its fluid level is above motor-pump unit 60. This reservoir and the components connected therewith are substantially filled with hydraulic fluid. Small pump P5 and the larger pump P10 are connected in parallel with reservoir 101 and discharge into a common line 102 leading to the main valve 83 such as a Vickers sequencing valve Model RT06 F3-23. This valve is shown in FIG. 1 as mounted on the side of the motor-pump unit 60 which is supported on the power transmission housing 50. The discharge side of the larger pump P10 includes a check valve 103 to prevent backflow therethrough when only pump P5 is operating. The smaller pump P5 discharges into conduit 102 through a suitable sequence valve 104, such as a Vickers Model RT06 B2-23 set to open at a suitable minimum pressure, such as 350 psi. This relatively low pressure fluid on the inlet side of valve 104 pressurizes the distributing line 105 at a suitable pressure for distribution to various auxiliaries via lines 107, 108 and 109. Thus line 107 leads to the rotor brake cylinder 58, line 108 leads to the door cylinder 137 and line 109 leads to the door lock cylinder 130.

Branch line 107 includes variable restrictor 125 and supplies fluid to the rotor brake cylinder 58 and to the normally open solenoid valve 126 discharging to the fluid return line 74. The brake cylinder 58 is normally held retracted when the hydraulic system is not pressurized by the fail safe brake spring 56 and is effective to hold the brake set against rotor 47. This provides assurance that the cab cannot move along the screw when line 107 is not pressurized to a predetermined pressure controlled by restrictor 125 and solenoid valve 126. This valve remains open until all doors are closed whereupon it is energized and closed so that the fluid pressure between restrictor 125 and valve 126 becomes effective to release the brake 48 on rotor 47.

Line 108 conducts low pressure fluid via the metering valve 141 to the door operating cylinder 137 via the normally closed solenoid-operated 4-way valve 135 which is provided with spool-operating solenoids A and B at its opposite ends. When solenoid A is energized cylinder 137 functions to close the door and, when solenoid B is energized, the cylinder functions to open the door. As the door reaches closed position the fluid admitted to the rod end of cylinder 137 also flows through line 109 to the door locking cylinder 130 thereby retracting its piston 130 in opposition to the compression spring 132, to a position permitting the counterweighted latch 134 to lock the door closed and simultaneously close switch 133. However, when solenoid B of the 4-way valve 135 is energized, pressurized fluid is supplied to the right hand end of door cylinder 137 as fluid in its rod end exits to reservoir 101 via the 4-way valve. Spring 132 in the locking cylinder 130 also extends its piston 131 forcing the liquid in the rod end of the cylinder to escape to the reservoir along with the fluid discharging from the rod end of cylinder 137. The extension of piston 131 unlocks the hall access door to the particular floor then being serviced by the elevator cab. The elevator cab door switch 142 (FIG. 15A) is in series with switches 133 and is closed when the cab door is manually closed. Accordingly, the cab cannot be operated unless all door locks and switches are closed.

As explained above, when all doors are closed, switches 133 and 142 are closed thereby energizing valve 126 to its closed position. This blocks the escape of fluid from the upper end of line 107 and the pressure above restrictor 125 in line 107 now increases and operates brake cylinder 58 to release the brake from rotor so that the cab can move to a new level along screw 16.

To safeguard against injury from the power operated door, the door operating cylinder 137 includes a low pressure relief valve 136 normally closed but set to open in case there is opposition to the closing of the power-operated elevator hall door, thereby permitting fluid to drain back to the reservoir through the normally open valve 138. However, once the door is closed, solenoid vlave 138 is energized to close thereby preventing opening of the door once it has been locked closed and until the cab is at a floor level.

When the doors are closed, the door close relay DO is energized. As this occurs, a variable timer relay T10, settable to close its contact after a predetermined time from 1 to 10 seconds, closes thereby activating the larger pump P10 which circulates fluid from tank 101 past check valve 103 into line 102 leading to the main valve 83 and thence to motor-pump unit 60 via line 147. Main valve 83 is a pilot operated relief valve having a housing slidably supporting a piston 117 the stem of which has a poppet valve 118 at its lower end. The stem of piston 117 has a passage provided with an adjustable flow restrictor 115 discharging into chamber 116 over-lying the piston. Compression spring 119 is located between the top of piston 117 and an adjustable stop 120 seated in the main body of valve 83.

Chamber 116 is in communication with line 110 leading to the normally closed high speed down solenoid valve 112 which discharges through line 113 to the main fluid return line 74. Chamber 146 beneath piston 117 opens into line 147 containing the motor-pump unit 60. This unit is connected to the fluid return line 74 by line 150.

During upward cab travel, a portion of the high pressure fluid driving motor-pump 60 and rotor 47 enters the bottom of main valve 83 and flows past the partially open poppet valve 118 into chamber 146, and thence through line 147 to the motor-pump unit 60, and then through line 150 into the unpressurized fluid return line 74. Another portion of the pressurized fluid from line 102 bypasses the main valve through line 148 check valve 149 and thence to the motor-pump unit 60. The fluid in the main valve does not elevate its piston 117 at this time because the high speed down solenoid valve 112 connected to valve chamber 116 is closed thereby preventing the escape of fluid from main valve chamber 116.

When the doors are closed, the door relay DO is activated thereby initiating upward travel and the normally open speed control valve 168 is energized and closes; hence the fluid pressure in the head end of cylinder 160, for operating needle valve 158, drops relative to the higher pressure in the rod end of the cylinder 160. This higher pressure acts to gradually close the escape of fluid through needle valve 158 thereby gradually cutting off flow in pilot line 156 and gradually closing the unloading valve 155, such as a Vickers pilot operated relief valve Model CT06 C-40. While the cab is gaining upward speed, relay T10 is timing out thereby closing switch T10-1 in the power supply to the large pump P10 at which time the speed control needle valve 158 is closed and so is the flow regulating valve 155 in line 154. Under these conditions the cab is propelled upwardly at high speed by motor-pump 60. As will be evident from the detailed descripiton of the electrical schematic to be made presently, the power supply leads to pump P10 containing the normally open switches PMS7 and TCA6 are closed when a person using the elevator for upward travel depresses the up call button CB2, FIG. 14B.

The speed control auxiliaries are provided with adjustable flow restrictors, a first restrictor 165 being located in line 164 interconnecting line 105 and pilot line 156, a second restrictor 166 being located in line 161 leading into the rod end of cylinder 160, and a third restrictor 167 being located in line 162.

Low and High Speed Governor Switches

Frequent use of the elevator and or the transport of heavy loads can cause a substantial temperature rise in the hydraulic fluid and reduce its viscosity with the result that the operating characteristics of the speed control auxiliaries fail to slow the cab travel at a suitable rate during the approach to a floor level. These undesirable occurences are circumvented in a highly satisfactory manner. To this end there is shown in FIGS. 4 and 4A governor such as a fly ball governor 169 coupled by belt 70 to rotor 47. The governor is suitably supported on the transmission housing 50 and is equipped with a normally open low speed switch **169*a* and a normally closed high speed switch 169*b* suitably rigidly supported for actuation by the governor controlled cam 169*c* which rises and falls in response to changing governor speed. Switch 169*a* is positioned to close if the cab speed exceeds a predetermined speed such as 18 to 20 feet per minute during deceleration or acceleration while the cab is travelling within an approach zone of a selected station. The high speed switch 169*b*** is positioned to open if the cab speed exceeds a preselected desired fast rate between station approach zones such as 100 feet per minute. It will of course be understood that either of these speed limits are matters of designers choice and may be varied to suit particular operating conditions or objectives.

It will therefore be apparent that, during acceleration, the governor switch **169*a* closes and remains closed and, during deceleration the switch opens as the cab slows during the approach to a selected floor level. When this occurs contact GL1 recloses to activate and close the speed control valve 168. This slows down the opening of needle valve 158 aided by the flow of fluid from line 105 through line 161 and restrictor 166 into the rod end of cylinder 160. Consequently the governor switch 169*a* quickly recloses in response to the resulting gain in speed of rotor 47 permitted by the resulting increased flow from line 102 through line 154 and regulator valve 155 into the fluid return line 74. In this manner the governor may cycle momentarily and repeatedly as necessary to prevent cab speeds in excess of the desired maximum speed during the deceleration cycle controlled in major part by needle valve 158 and regulator 155**.

Likewise during rapid cab travel between approach zones of travel, the high speed governor switch **169*b* opens as the cab speed reaches its preselected high speed, such as 100 feet per minute, thereby deactivating high speed relay GH. Contact GH5 of this relay then opens so that the speed control valve 168 briefly opens and releases sufficient fluid from the pressurized fluid line 102 via the unloading valve 155 to slow cab travel below 100 FPM whereupon governor switch 169*b* recloses to maintain normal high speed operation. A more detailed explanation of the functioning of components controlled by the governor speed responsive switches will be made below. It will therefore be recognized that the governor cooperates with the speed control valve 168, the needle valve 158 and the pilot controlled unloading valve 155** to control cab travel smoothly and shocklessly while accelerating and decelerating in station approach zones and during fast travel therebetween.

DECELERATOR COMPONENTS

The safety decelerator components for the cab are located at the base of the elevator main frame, as is shown in FIG. 1, and in the lower right hand corner of FIG. 14. As there shown, there are a pair of identical decelerators, designated generally 170. Each has a main cylinder 171 floatingly supported on the upper ends of a plurality of coil springs 172 having their lower ends resting on pedestals or other rigid supports 173 positioned at the base of the elevator main frame. Each cylinder is provided with a snubbing piston 174 normally held fully extended upwardly by fluid supplied to the lower end of the cylinder by means which will now be described.

The decelerators are supplied with pressurized fluid from the low pressure line 105 by line 175 opening into the decelerator solenoid valve 176. The opposite ends of the decelerator cylinders 171 are interconnectod by respective loop lines 177 each provided with a flow restrictor 178. Any excess fluid present in the rod end of cylinders 171 returns to the fluid reservoir 101 via line 179. These two loop circuits and cylinders 171 are maintained charged with fluid from line 105 and the decelerator solenoid valve 176. The outlet of valve 176 is connected as shown to the check valves 180 which are arranged to prevent fluid in the lower end of cylinders 191 from flowing freely into the upper end during a snubbing or decelerating operation and whereby fluid can reach the upper end of the cylinders only by passing downwardly through flow restrictors 178. In consequence, it will be recognized that the restrictors supplement the springs 172 in cushioning the cab during downward over-travel whereas restrictors 178 cushion and slow down re-expansion of the springs 172 thereby protecting screw 16 against shock, vibration, and a suddenly applied high compression load as the springs expand. Except for this expedient, the recoil of the powerful springs 172 could inflict severe if not fatal damage on the screw and possibly other components.

Although the decelerators have been shown in FIG. 1 as mounted on the base of the elevator shaft, it will be understood that they may be inverted and mounted on the underside of the cab. In either mounting mode, decelerators serve to cushion the cab should it fail to slow down in the normal way as it approaches the bottom of the shaft. If the supply of fluid in the decelerator subassembly becomes depleted for any reason, make up fluid is automatically supplied from line 105 via the decelerator solenoid vlave 176.

OPERATION

The operation of the elevator will be described with particular reference to the schematics shown in FIGS. 13, 14, 15A and 15B.

Assuming that the elevator cab is stopped at the first floor level it will be noted form FIG. 13 that the bottom overtravel switch BOT is closed and that both the first floor level switch LS-1 and the first floor switch FL-1 are open. Each of these switches is operated by separate cams which are laterally offset from one another vertically of the shaft and, in consequence, each is effective to operate only its associated switch or valve as the cab travels therepast. Also diagrammatically illustrated in FIG. 15B is the fact that the speed control valve 168 is in its normal open position; the rotor brake control valve 126 (FIG. 15A) is in its normal open position; the unloading valve 155 (FIG. 13) is open; the door actuation valve 135 is in neutral (FIG. 14); and the high speed down control valve 112 (FIG. 12) is in its normal closed psoition. Also both of the hydraulic pumps P5 and P10 are inactive and all parts of the hydraulic system are filled with unpressurized fluid from reservoir 101 having a fluid level above the motor-pump 60 and valve 83.

To use the elevator, a passenger enters the elevator on the first floor, manually closes the door (operation can be automatic) thereby closing the elevator door switch 142 (FIG. 15A), and presses the UP call button CB-2 (FIG. 15B).

It will be noted that when the elevator is stopped and in readiness for use with the door open, the left hand power lead 186 is hot since each of the switches BOT, TOT, safety switch 68 and stop switch 187 (top of FIG. 15A) is closed. If the cab hall door is open, switch 142 is open and so is the first switch 133. Hence the only control system component energized at this time is the time delay timer relay T connected across the main power lines 186 and 188 through the normally closed brake relay contact BR-3. When the timer relay T has been energized longer than its manually adjustable normal delay period, such as 1 to 10 seconds, its normally closed contact T5 is open with the result that no power is supplied from hot line 186 to the pump-motor relay PMS or to the timer relay PMST. Once on board, the passenger closes the UP call button CB-2 (FIG. 15B) for the second floor thereby energizing the top call relays TC and TCA. Contact TCA 5 closes to energize the door closing relay DC thereby opening its contact DC-2 and closing its contact DC-5; contact TC-5 closes to activate the brake relay BR; its contact TC-6 closes to provide a holding circuit for the TC relay, and its contact TC-3 opens to deactivate the first floor call button control circuits CB-1 and PB-1.

When the brake relay BR is energized by the TC-5, its contacts BR-5, BR-6 and BR-8 close and BR-3 opens. The opening of BR-3 deactivates timer T, the closure of contact BR-5 activates the pump motor starter timer relay PMST and the PMS relay; and the closure of contact DC-5, as mentioned above, activates solenoid A thereby opening the 4-way valve 135 controlling operation of the hall door operating cylinder 137 (FIG. 14).

When the PMS relay is energized by the brake relay BR, as described above, its contact PMS6 closes to energize the smaller pump motor P5 tc supply relatively low pressure fluid to the hydraulic circuit and particularly to the auxiliary hydraulic components illustrated in FIG. 14. Also PMS contact PMS4 opens to deactivate all call buttons for the cab.

Immediately upon starting, pump P5 pressurizes the fluid in the minimum pressure line 105 (FIG. 14) to supply fluid at low pressure via line 108, metering valve 141 and the 4-way vlave 135, now shifted to the right by solenoid A, to the door actuation cylinder 137, thereby closing the hall and cab doors. Fluid present in the right hand end of cylinder 137 returns to the tank 101 via line T. Since the spool of 4-way vlave 135 is now shifted rightward, pressurized fluid passes through the rod end of door cylinder 137 to close the main door while also passing through line 109 to door locking cylinder 130 to retract its piston 131 in opposition to spring 132. The retraction of piston 131 allows a detent on the main door to underride door latch 134 as the door reaches its fully closed postiion to lock the door closed. Latch 134 is counterweighted to pivot counterclockwise into latching position while simultaneously closing the first floor locking switch 133, it being noted that each floor is provided with a locking switch connected in series with one another and with the cab door switch 142. When all door switches 133 and 142 are closed, power is reapplied to the door locking solenoid valve 138 thereby closing this valve to supplement latch 134 in locking the hall door closed.

So long as any elevator door is open the normally open valve 138 cooperates with the adjacent relief valve 136 in safeguarding gainst injury of a person or any object by the power operation of the door. Thus, relief valve 136 is set to open in response to a predetermined resistance, such as 30 pounds, to the closure of the door and releases sufficient fluid from line 108 to permit further closing of the door and provides an automatic positive safeguard against injury from the power door.

It will be recalled that the time delay relay PMST was energized simultaneously with the PMS relay. When the PMST relay times out, after several seconds, the door relay DO will have been energized to close its contact Do-6 and, in consequence, contact PMST-1 may now be opened safely because contact D06 is closed to maintain a power supply to the hot bus bar 186A along the left hand side of FIG. 15B. As was pointed out above, when the door relay DO is energized, brake relay contacts BR-6 and BR-8 are closed to energize and close the brake solenoid valve 126. Also DO-7 contact closes thereby energizing the high speed governor relay GH via the normally closed high speed governor switch 169*a* (FIGS. 4*a*, 15B). Contact GH5 now closes to energize and close the speed control valve 168 via power supplied through D07, DW2, GL1 and GH5.

The closing of the speed control valve 168 operates as described above to relax the pressure on the head end of the speed control cylinder 160 (FIG. 14) with the result that the fluid pressure on the smaller area rod end of cylinder 160 is effective to close valve 158 in pilot line 156 whereupon the unloading valve 155 gradually closes. As this takes place, fluid in line 102 is flowing in increasing amounts to the motor-pump unit 60 via line 105 and check valve 149 as well as via throttle valve 118 of main valve 83, valve 118 being elevated to a more open position by the fluid pressure in line 102. After the cab has moved upwardly a short distance, the cam for floor level switch FL-1 (FIG. 13) closes this switch. As the cab increases in speed to about 20 feet per minute, switch 169*a* of the low speed governor closes and activates the governor low speed relay GL. Contact GL-1 now opens and GL5 closes but solenoid valve 168 remains energized and open through the closed contact TC8 of the top call relay TC.

Timer T10 which was energized by the closing of PMS 7 contact times out after a suitable predetermined period such as 3 to 5 seconds thereby closing its contact T10-1 to complete a circuit through contacts PMS7 and TCA6 to start pump P10 and provide a second and alternate power supply to this pump which supplements the small pump P-5 in furnishing fluid to motor-pump 60 at a pressure of about 1,500 psi to drive the motor-pump 60 at high speed with the flow continuing to pass in parallel through the fully open throttle valve 118 and through check valve 149.

Valve 155 closes gradually and the transition from slow to high speed is smooth and shockfree.

Both motors of pumps P5 and P10 continue to operate until the cab approaches within about six inches of the second floor at which time zone switch ZS-2 mounted along the side of the shaft engages its operating cam on the sidewall of the cab (see dotted line showing of the cab in FIG. 13) and opens this switch thereby deactivating the speed control valve 168 to open this valve. When valve 168 opens, some pressurized fluid from line 105 escapes through restrictor 167 to the fluid reservoir 101 and other fluid flows to the right hand end of cylinder to shift its piston rightward to gradually open needle valve 158 thereby gradually opening the pilot controlled unloading valve 155 to release pressurized fluid from line 102 for return to the tank 101. Since LS2 is now open, top call relay TC is deactivated and its contact TC8 is open. So is contact GL1, but door relay contact D07 is closed to arm the slow speed governor switch 169*a* and its relay GL. The open floor level switch LS-2 also deactivates the top call relay TC and TCA and the opening of its contact TCA6 cuts off the power supply to pump P10.

As the cab slows to approximately 20 feet per minute, the low speed switch 169*a* of governor 169 opens and contact GL1 of the governor speed relay GL closes to reactivate and close the speed control valve 168. In consequence, flow of fluid into the head end of cylinder 160 ceases and fluid from line 105 enters the rod end of the cylinder to slow down if not reverse the opening movement of needle valve 158. Less fluid is thereby permitted to escape from line to the reservoir via regulator valve 155 and the speed of rotor 47 can gain slightly until the governor switch automatically recloses to repeat the governor controlled deceleration cycle. In this manner, upward cab travel is gradually decelerated during its final approach to the selected upper level switch FL2 is opened by the cab thereby deactivating brake relay BR and opening its contacts BR5, 6 and 8. The opening of BR6 opens solenoid valve 126 to release pressurized fluid from the rotor brake 40 so that its power spring 56 clamps the rotor 47 against rotation along screw 16. As this occurs the speed control valve is deactivated and the door relay DO is deactivated as the cab stops. The speed control valve 168 being open, fluid from line 105 is supplied to the head end of cylinder 160 and is effective when pump P5 is again energized to bleed fluid from the pilot chamber of regulator valve 155. The described deactivation of the brake relay BR closes its contact BR3 to reactivate time relay T for a sufficient period required for pump P5 to supply fluid to operate the door operating components before timing out and opening the power circuit to P5.

The deactivation of the DO relay as mentioned opens its contact DO-7 to deactivate speed control valve 168 and opens DO-8 to drop out the door closing relay DC so that its contact DC2 closes and DC-5 closes to energize solenoid B. This shifts the spool of 4-way valve 135 to the left to supply pressurized fluid to the head-end of door cylinder 137. The speed control needle valve 158 is also restored to its fully open position before pump P5 shuts down. Spring 132 of the door latching cylinder 130 extends its piston to unlatch the main door latch 134 and open its associated switch 133 while fluid escapes to the reservoir from the rod-end of door cylinder 137. Contact T5 of time relay T opens as its timing period expires and drops out the PMS relay to open its contact PMS to cut the power to pump P5.

The elevator system is now shut down with all components positioned as shown in FIGS. 13, 14, 15A and 15B with the exception that the cab is at the second floor and in readiness for use to return to the first floor.

DOWN OPERATING CYCLE

The DOWN operating cycle is generally similar to the UP cycle, a major difference being that, upon release of the rotor brake 48, rotor 47 immediately begins to autorotate downwardly along screw 16 and drives motor-pump 60 in the reverse direction to pump fluid in the reverse direction, the fluid being pumped out of the flooded return line 74 and circulated downwardly under pressure through chamber 146 of main valve 83 and into lines 102, 154 and back to line 74 via the now open unloading valve 155. Check valve 103 at the lower end of line 102 prevents the escape of fluid through pump P5. It will be recalled that valve 155 was in its open position as the cab reaches the second floor and is always in this position at the end of each up or down operating cycle.

The passenger enters the cab, closes the door thereby closing door switches 133 and 142 (top of FIG. 15A)

and closes the DOWN call button CB1 shown in the lower right hand corner of FIG. 15B. The momentary closing of this button energizes the bottom call relay BC since switch LS-1 is closed when the cab is not stopped at the first floor. Thereupon contacts BC-2 open to deactivate all other call buttons and its contact BC-1 closes to provide a holding circuit which maintains relay BC energized when the passenger releases the down call button CB-1. The operaiton of the system from this point on is substantially the same as described in connection with the UP cycle with a few exceptions.

If the operator has entered the cab and closed the cab door, switch 142 will close with the door, but the second floor main door switch 133 will remain open until closed by the power cylinder 137 (FIG. 14). Momentarily, the only system component then energized is the time delay relay T. Assuming that the T relay has been energized for several seconds, its normally closed contact T-5 will be open and no power can be supplied from hot line 186 to the PMS relay or to the timer relay PMST. After closing the cab door, the operator closes the bottom call button CB1 thereby energizing the decelerator valve DCE (bottom of FIG. 15B) to furnish make up fluid to the decelerator components (if needed) and closing call button CB1 also energizes the bottom call relay BC. Since LS1 is closed so long as the cab is above the first floor position and contact BC-1 closes and its contact BC-2 opens to deactivate the upcall button circuit with the result that the speed control vlave 168 is inactive and closed. Also contact BC-5 closes to activate brake relay BR. Brake relay contact BR-3 opens to deactivate the timer relay T; contacts BR-6 and BR-8 close to activate the normally open brake valve 126 in the hydraulic brake circuit and to activate the power circuit of the DOWN relay DW and thereby open its contact DW-3 to disarm the power supply to the large motor P10; brake relay contact BR-5 closes to activate the PMS relay thereby energizing the small pump P5. This pump now operates to pressurize lines 105, 107, 108 and 109.

When contact BCA5 of the bottom call relay BCA closes it automatically activates the door closing relay DC opening its contact DC-2 and closing its contact DC-5 to energize the A solenoid of 4-way valve 135 (FIG. 14). Accordingly, the pressurized fluid now present in line 108 passes to the rod end of door cylinder 137 (FIG. 14) to close the main door. Part of the fluid passes on through cylinder 137 to the door locking cylinder 130 to retract its piston 131 permitting latch 134 to latch the main door closed and close the door switch 133.

Since the brake has been released on rotor 47, when the brake relay BR was activated, the weight of the cab on rotor 47 causes this rotor to auto-rotate downwardly along screw 16 to drive motor-pump 60 in reverse. It will be recalled that the high speed down valve 112 (FIG. 14) is now open with the result that the pressurized fluid discharging from motor-pump unit 60, now being driven as a pump by the autorotation of rotor 47, flows through line 147 into chamber 146 of main valve 83 where it is effective to elevate piston 117 of valve 83 and open its throttle valve 117. This permits the pressurized fluid entering chamber 146 to pass downwardly past the open valve 118 into line 102. All fluid must pass by the throttle valve since check valve 149 in line 147 prevents any fluid bypassing the main valve.

The pressurized fluid entering the upper end of line 102 seats check valve 103 at the outlet of the larger pump P-10 and escapes to the return line 74 through the now open unloading valve 155. Since the speed control valve 168 is disabled by the now open contact BC4 and bottom call relay BC-6, valve 168 is open so that the pressurized fluid enters the head end of speed control cylinder 160 to maintain the needle valve 158 open. This permits fluid in pilot line 156 to escape so that unloading valve 155 remains open as the cab travels downwardly at high speed.

When the cab reaches a position approximately six inches above the first floor, the cab actuated limit switch LS-1 (FIGS. 13, 15B) opens to disable bottom call relay BC and BCA. This opens contact BCA7 in one of the power supplies to the door closure relay DC. However, contact D08 of the door relay DO remains closed to supply power to the door closure relay DC. Contact BCA7 opens to disable the down relay DW thereby opening its contact DW-1 and DW-3 to deactivate the high speed down valve 112. The closure of valve 112 permits fluid to bleed through restrictor 115 in the piston 117 of main valve 83, causing the piston to move down thereby gradually closing the safety valve 118 to slow down motor-pump 60 as it approaches the lower floor level. Contact BC-4 of the disabled BC relay also closes to activate the speed control valve 168 to admit pressurized fluid from line 105 to the head end of cylinder 160 thereby slowly closing needle valve 158 to unload regulator valve 155 in the manner fully described above to gradually slow the cab in its approach to the lower level. During cab deceleration, the speed governor may and usually does open and close its speed responsive switch **169*a* to activate the governor speed relay GL momentarily in the same described above in connection with the deceleration cycle at the end of upward cab travel. Thus, the governor alternately activates and deactivates the speed control solenoid 168 to assure smooth deceleration of the cab as it comes to rest at the lower floor level. As the cab slows to a virtual stop, the cab-operated floor switch FL-1 (FIGS. 13 and 15A) opens and cuts the power to brake relay BR and its contacts BR-6 and BR-8 open. This cuts the power to the door relay DO, to the down relay DW and to brake valve 126 to open this valve. This releases pressurized fluid from brake line 107 and allows spring 56 to set the brake 48 on rotor 47** to hold the cab firmly and immovably at the first floor level.

When the DC relay was disabled by the opening of door relay contacts DO-8, DC contacts DC-2 and DC-5 reverse their respective positions thereby enabling solenoid A of the 4-way valve 135 to release fluid from cylinders 130 and 137. This opens door switch 133, unlatches door latch 134 and causes cylinder 137 to open the main door.

The opening of door switch 133 cuts the power to the automatic components but the small pump P5 remains in operation because contact BR-3 is now closed to activate timer T which times out in a short period, such as 3 or 4 seconds, so that the contact T-5 opens and shuts down the PMS relay and pump P-5. As the operator opens the cab door, the door switch 142 opens to cut the power from hot line 186 leaving the entire system deactivated. While timer T is timing out its contact T-5 remains closed to maintain the PMS relay and pump P5 running to provide power to operate the doors and to recycle valves 158 and 155 to their fully open positions in readiness to initiate a slow but gradually increasing cab operating cycle when needed.

An important additional fail-safe aspect of the above described elevator system is its ability to lower the cab slowly and safely to the first floor upon the highly unlikely but conceivably possible failure of both the hydraulic and electrical systems with the rotor brake 58 released as by blockage or failure of its spring 56. This is accomplished automatically and without need for any action by passengers then present in the cab or by elevator service personnel, the automatic lowering cycle being as follows. Because of the auto-rotation characteristics of screw 16 and rotor 47, upon the failure of either the hydraulic or electrical system, rotor 47 starts to rotate downwardly along screw 16 thereby driving motor-pump unit 60 in reverse in an effort to circulate the fluid downwardly through line 147 and main valve 83. Solenoid valve 112 will of course assume its normally closed position by reason of the electrical system failure with the result that safety valve 118 of the main valve 83 will virtually close by equalization of the fluid pressure in its upper and lower chambers 116 and 146. However, safety valve 118 is prevented from quite fully closing by the adjustable set screw 121 (FIG. 14) thereby permitting sufficient leakage of fluid downwardly therepast for slow continued auto-rotation of rotor 47 until the cab comes to a stop at the ground floor. It is also pointed out that seepage of fluid past the rotor of motor-pump unit 60 may be utilized in lieu of the adjustable stop screw 121 or relied upon to supplement the leakage past throttle valve 118.

SECOND ILLUSTRATIVE EMBODIMENT

A second illustrative embodiment of the invention, illustrated in FIGS. 16 through 22, embodies a number of unique structural features not present in the first embodiment.

Both embodiments employ esstentially the same hydraulic and electrical control components shown in FIGS. 13, 14, 15*a* and 15*b*, but differ structurally in several important respects. The same or similar components will be identified by the same reference characters as in FIGS. 1 through 13 but will be distinguished therefrom by the addition of a prime.

Among the more important differences between the first and second embodiments are the following:

The steep-pitched screw 16' is advantageously made from tubular stock and, in larger installations, is preferably driven from a transmission housing 50' located at the base of the screw although it will be understood that the screw may be driven from its upper end, particularly in lighter load installations. If the screw is made in larger diameters, such as five to twelve or more inches in diameter, high cab travel speeds are obtainable at relatively low rotational speeds of the screw. Other advantages include greater strength, high modulus of elasticity, resistance to vibration and the other related static and dynamic properties. The rotor 47' engaging the threads of screw 16', held stationary and against rotation about the screw, includes a tubular extension cooperating with the rotor to support the cab 10'. Another important difference is that the elevator main frame preferably comprises a tubular housing 200 embracing the screw substantially throughout its length and rigidly anchored to the foundation. This tubular main frame is slotted for the major length thereof to accommodate the cab supporting brackets anchored at their inner ends to rotor 47' and its tubular extension 231. These latter components are provided with a plurality of rollers in rolling contact with the interior surface of the tubular main frame. It will therefore be recognized that this main frame not only provides a main frame for the elevator assembly generally, but that it also serves importantly to maintain the screw stabilized coaxially thereof without reliance on retractable screw stabilizers found desirable in higher installations of the first embodiment.

Referring now more particularly to FIGS. 16 and 17, the tubular main frame 200 is rigidly supported upon two or more sets of supporting legs here shown as comprising heavy duty steel channel members 201 secured together in echelon with the uppermost channel member welded to spaced apart areas along the sides of the main frame. The two sets of supporting legs are located so as to straddle the transmission housing 50' which is floatingly supported on the installation foundation in a manner to be described more fully presently.

The upper end of main frame 200 is welded to a strong plate 202, the junction therewith being strengthened by depending channel members 203 having the free edges of the sidewalls welded to the exterior surface of main frame 200.

The manner in which the upper end of screw 16' is supported at the top of the main frame 200, 202 is best shown in FIGS. 16 and 18. As there shown, screw 16' extends through an opening 204 and through a pair of self-aligning thrust bearing plates 205 into a tubular housing 206 enclosing a roller thrust bearing 208. A large nut 210 mates with conventional threads on the upper end of screw 16' and bears against the upper race of the bearing 208. The upper and lower ends of housing 206 are welded to and closed by end plates 212, 213. The upper end of screw 16' passes through openings in these plates and is suitably sealed thereto by O-rings or the like. Housing 206 is normally charged with lubricant.

Fixed to the upper end of screw 16' is a brake drum 47' of a fail-safe brake 48' of the same type shown in FIG. 12. This brake includes a pair of semi circular brake shoes 53' having one pair of adjacent ends pivotally interconnected by supporting pin 54' anchored to the underlying plate 212. The non-pivoted ends of the two brake shoes are interconnected and normally urged against the brake drum 47' by a powerful spring 56' so long as the elevator is not in use. When it is in use, the brake shoes are pivoted away from drum 47' by pressurized fluid supply to the hydraulic cylinder 58'.

The means for supporting the upper end of screw 16' at the upper end of the tubular main frame 200 includes resilient means permitting slight rotary movement of the fail-safe brake 48' and housing 206 about a vertical axis. The details of this resilient mounting are best shown in FIGS. 18 and 19 and include a pair of inverted U-shaped members 216 and 219 lying in vertical planes at right angles to one another with their bight portion welded together The lower ends of the legs of member 216 are rigidly secured to the thrust bearing housing 206 by diametrically aligned radial arms 217, 217. The lower ends of the legs of member are welded to the diametrically opposed sides of thrust bearing housing 206 by radial arms 220 as is best shown in FIG. 19.

The described frame members 216 and 219 are held resiliently against rotation about a vertical axis by pairs of opposed springs which will now be described. As is best shown in FIG. 19, a pair of upright brackets 224, 224 are welded to plate 202 of the main frame on the opposite sides of the radial arms 217, 217. On the opposite sides of each of these brackets 217 are a pair of cup-shaped housings 225 supported on brackets likewise secured to plate 202. Strong compression springs 226 mounted in housings 225 have their other ends seated in pockets of arms 217. From the foregoing it will be recognized that the described resilient assembly permits very limited pivotal movement of screw 16' about its vertical axis and that, normally, springs 226 hold the screw and arms 217 seated against brackets 224 (FIG. 19).

Referring now to FIGS. 16, 18 and 21 there will be described the structure for supporting and propelling the elevator cab 230 lengthwise of screw 16'. Screw 16' is embraced by a rotor 47' of the same construction as described above for the first embodiment. The upper end of rotor 47' is rigidly coupled to a coaxial tube 231 (FIG. 21) by a flanged coupling 233, the flanges of which are separated by a resilient gasket 234. Tube 231 extends upwardly from rotor 47' for a distance of several feet in an area laterally opposite the back wall of cab 230 and is rigidly anchored to the cab by a pair of brackets 235. As is best shown in FIG. 1, the tubular main frame 200 is provided with a slot 236 extending substantially throughout its length to accommodate the cab supporting brackets 235.

An additional and important function of tube 231 is to aid in stabilizing screw 16' as well as to provide a secure and stabilized rolling support for cab 230. These functions are performed by sets of roller assemblies 240, 241 located on the opposite sides of tube 231 adjacent the upper and lower ends thereof as best appears from FIG. 16. The upper set of guide rollers 241, best shown in FIGS. 18 and 20, comprises rollers 242 each supported in separate brackets 243 welded to the outer sides of tube 231. The lower set of roller assemblies 240 shown in FIGS. 21, 22, are identical with the roller assemblies 241 except they are located on the left hand side of 231 whereas assemblies 241 are located on the upper right hand side of this tube.

Cab 230 of any conventional construction is equipped with cab door not shown of the same type described in connection with FIGS. 1–15*a* and is equipped with hydraulically operated door locking auxiliaries identified by reference 133 in FIG. 14. Additionally the cab is provided with at least one and preferably two sets of rollers 246 (FIG. 22) operating in guide channels 247 extending vertically of the elevator shaft and cooperating with screw 16' in confining cab travel to a vertical path. Desirably there is a similar roller 246 and guide channel 247 on the opposite side of the cab and cooperating with one another to prevent the cab from shifting in either direction laterally of main frame tube 200.

Referring now to FIGS. 16 and 17 there will be described features of the elevator apparatus located at the base of its shaft. The lower end of suspended screw 16' extends into the upper side of the power transmission housing 50' floatingly supported on a plurality of compression springs 250 surrounding spindles 251 anchored in and projecting upwardly from the foundation. Also supported on the foundation and encircling these springs is a tube 252 supporting a guide ring 253 having a loose telescopic fit within a tubular ring 254 welded to the bottom of the transmission housing 50'.

Referring to FIG. 17, there is shown means permitting only restricted rotary movement of transmission 50' about the axis of screw 16'. Four channel shaped members 260 projecting upwardly from the foundation to a position along the opposite sides of the transmission housing 50'. Compression springs 261 are mounted between these channel members and the adjacent sides of the transmission housing and cooperate in permitting the aforementioned slight horizontal rotary movement of the transmission housing about the axis of screw 16'.

Mounted on the upper side of transmission housing 50' is a second fail-safe brake 48' shown in FIG. 18 and located at the upper end of screw 16'. The hydraulic cylinder 58' is operable to compress spring 56' and release the brake shoes 53' whenever the brake relay BR is activated. Brake 58' is not present in the first described embodiment but it has been shown in FIG. 14 hydraulic schematic in order to indicate the portion of the hydraulic system to which its operating cylinder 58' is connected. It is to be understood that brake 48' is not actually required in the FIG. 1 embodiment and is therefore to be eliminated from FIG. 14 when that schematic is employed in the first described embodiment.

The governor drive belt 160' will be understood as connected to a drive pulley embracing and fixed to the lower end of screw 16'. Preferably this belt is provided with a wear responsive switch similar to switch 68 shown in FIG. 4 of the first embodiment and effective to deactivate the entire elevator system whenever the slack in the governor drive belt 170 becomes worn beyond a safe operating point.

The motor-pump unit 60' is mounted on the top of transmission housing 50' (FIG. 17) and is employed to drive the screw 16' terminating internally of housing 50' in the same manner described in connection with FIG. 4 of the first embodiment, the only difference being that the motor-pump 60' drives the screw 16', whereas, in the first embodiment, motor-pump 60 drives the rotor 47.

The remaining component subassembly comprises at least one and preferably a plurality of cab decelerators 170' (FIGS. 16–17) of the same construction described above for the first embodiment and illustrated in the hydraulic circuit in the same manner as described in connection with FIG. 14 and serve the same purposes and function as there described.

OPERATION OF THE SECOND EMBODIMENT

The embodiment shown in FIGS. 16 through 22 is equipped with the same hydraulic and electrical components illustrated in FIGS. 13 through 15B of the first embodiment and function in precisely the same manner to control the operation of the second embodiment. Accordingly, it will be unnecessary to repeat the description of the operation set forth above.

While the particular embodiments of a rotor and screw elevator equipped with a fail-safe control system herein shown and disclosed in detail are fully capable of attaining the objects and providing the advantages hereinbefore stated, it is to be understood that they are merely illustrative and that no limitations are intended to the details of construction or design herein shown other than as defined in the appended claims.

I claim:

1. Elevator apparatus comprising:

a cab movable vertically of upright frame means;

vertically suspended steep-pitch screw means operatively associated with said frame means;

rotor means encircling and engaged with said screw means and operable to propel said cab therealong;

means holding one only of said screw means and said rotor means stationary and against rotation;

hydraulic motor-pump means having a rotary driven connection with one of said screw means and said rotor means not held stationary and including means for supplying pressurized fluid thereto to propel said cab upwardly therealong;

means normally holding the non-stationary one of said screw means and said rotor means against rotation thereby to hold said cab stationary and releasable to a position permitting auto-rotation of the non-stationary one of said screw means and said rotor means; and means for supplying pressurized fluid to said motor-pump means in a direction to propel said cab upwardly along said screw means and including means for controlling the flow of fluid through said motor-pump means in the reverse direction to permit downward cab travel along said screw means when the non-stationary one of said screw means and said rotor means is released for auto-rotation.

2. Elevator apparatus as defined in claim 1 characterized in that said means normally holding the non-stationary one of said screw means and said rotor means against rotation comprises self-setting fail-safe brake means and including hydraulic means for releasing said brake means when pressurized fluid is supplied to said motor-pump means to propel said cab upwardly along said screw means.

3. Elevator apparatus as defined in claim 2 characterized in the provision of means for controlling the flow of pressurized fluid to said motor-pump means to propel said cab upwardly and for permitting said motor-pump means to function in the reverse direction as a pump to permit said cab to travel downwardly along said screw means and which flow control means includes means for deactivating said brake means concurrently with the activation of said motor-pump means in either direction.

4. Elevator apparatus as defined in claim 2 characterized in that said hydraulic-powered motor-pump means includes fail-safe means permitting sufficient leakage of hydraulic fluid therepast to permit said rotor means to auto-rotate downwardly along said screw if said self-setting brake means fails to hold said rotor while said cab is in an elevated position along said screw.

5. Elevator apparatus as defined in claim 4 characterized in said fail-safe means is operable automatically to permit said cab to return slowly to the lower operating level thereof upon the failure of said brake means to hold said rotor against auto-rotation by either hydraulic or mechanical failure of said self-setting brake means.

6. Elevator apparatus as defined in claim 4 characterized in that said fail-safe means is operable automatically to permit said cab to return slowly to the lower operating level thereof even though there is an additional failure of said means for supplying pressurized fluid to said motor-pump means.

7. Elevator apparatus as defined in claim 4 characterized in the provision of electrical means for pressurizing hydraulic fluid supplied to said motor-pump means, and said fail-safe means being operative automatically to lower said cab slowly to the lower operating level thereof even when said electrical means is inoperable.

8. Elevator apparatus as defined in claim 2 characterized in the provision of means permitting the brake-equipped one of said rotor means and said screw means to autorotate automatically to lower said cab slowly to a lower operating level thereof upon failure of said brake means while said cab is above the lowermost operating level thereof.

9. Elevator apparatus as defined in claim 1 characterized in the provision of bearings for the opposite ends of said screw means, brake means normally holding said screw means stationary and non-rotary and including means to release the same thereby permitting said screw means to auto-rotate relative to said rotor means and lower said cab downwardly therealong.

10. Elevator apparatus as defined in claim 1 characterized in the provision of separate brake means located one at each end of said screw means cooperating to restrain said screw against rotation, and means for releasing said separate brake means to permit said screw means to auto-rotate relative to said rotor means and lower said cab downwardly therealong.

11. Elevator apparatus as defined in claim 10 characterized in the provision of means including thrust bearing means for suspending said screw means from the upper end thereof, and said brake means at the lower end of said screw means including means permitting limited lateral movement of said screw means.

12. Elevator apparatus as defined in claim 1 characterized in the provision of a pair of spaced-apart concentric flexible hoses for circulating fluid between said pressurized fluid supply means and said motor-pump means, the inner one of said hoses being used to convey pressurized fluid, and the annulus between said hoses being used to convey non-pressurized fluid and available to collect and convey fluid from said inner hose should the latter develop a leak or rupture.

13. Elevator apparatus as defined in claim 12 characterized in the provision of a fluid-tight sliding seal between one pair of adjacent ends of said pair of hoses to permit axial movement of said hoses relative to one another as said cab is propelled along said screw.

14. Elevator apparatus as defined in claim 1 characterized in the provision of stabilizer means for said screw means supported independently thereof and movable between a retracted first position retracted away from said screw means and an extended second position embracing an adjacent portion of said screw means, and means responsive to the movement of said cab along said screw means in the vicinity of said stabilizer means to shift the same from one of said first and second positions to the other position thereof.

15. Elevator apparatus as defined in claim 14 characterized in the provision of a plurality of said stabilizer means spaced along the length of said screw means.

16. Elevator apparatus as defined in claim 14 characterized in that said stabilizer means includes means for holding the same firmly in the retracted and extended positions thereof until forcibly moved away therefrom.

17. Elevator apparatus as defined in claim 14 characterized in the provision of a pair of pivoting jaw means on said stabilizer means engageable with said screw means by the movement of said jaw means into contact with said screw means thereby to pivot said jaws open and closed depending on whether said stabilizer means is starting toward its retracted position or approaching the end of its movement to the extended position thereof.

18. Elevator apparatus as defined in claim 14 characterized in that said stabilizer means includes toggle linkage means having operating means engageable with means mounted on said cab during vertical travel of said cab and operable to pivot said stabilizer means between the extended and retracted positions thereof.

19. Elevator apparatus as defined in claim 1 characterized in that said drive connection between said motor-pump means and said rotor means includes chain means, and means for sensing an unsafe operating condition of said chain means and responsive thereto to deactivate said motor-pump means.

20. Elevator apparatus as defined in claim 1 characterized in the provision of floating coupling means at the lower end of said screw means having one portion thereof fixed to said screw means and a second portion thereof secured to a fixed support; and said coupling means including means operable to permit limited movement of said screw means relative to said second portion of said coupling means.

21. Elevator apparatus as defined in claim 20 characterized in that said floating coupling means at the lower end of said screw means includes means for manually releasing said screw means from restraint against rotation about the axis thereof.

22. Elevator apparatus as defined in claim 21 characterized in that said floating coupling means is operable to support said screw means in compression and to hold said screw means against rotation while said cab moves downwardly therealong after failure of the means for suspending said screw means from the upper end thereof.

23. Elevator apparatus as defined in claim 1 characterized in the provision of hydraulically-powered access door into said cab, hydraulic means for locking said access door closed including means for substantially concurrently utilizing pressurized fluid to lock said access door closed and for releasing said means normally holding the non-stationary one of said rotor means and said screw means against rotation.

24. Elevator apparatus as defined in claim 1 characterized in that said means for supplying pressurized fluid to said motor-pump means includes valve means and electric control means equipped with switch means in the path of cab travel and automatically responsive to the presence of the cab in the vicinity of a selected floor level operable to slow the movement of said cab in the vicinity of said selected floor level and to propel said cab more rapidly elsewhere along the path of cab travel.

25. Elevator apparatus as defined in claim 24 characterized in that said pressurized fluid supply means includes first and second pump means, control means operable to utilize pressurized fluid from both of said first and second pump means to propel said cab rapidly upwardly, and means operable to permit rapid downward travel of said cab independently of pressurized fluid supplied by either of said first and second pump means.

26. Elevator apparatus as defined in claim 25 characterized in that said pressurized fluid supply means is operable to supply fluid at a first relatively low pressure and at a second relatively high pressure for rapid cab travel over the major portion of cab travel to a selected floor level.

27. Elevator apparatus as defined in claim 26 characterized in the provision of means for automatically converting said pressurized fluid supply means from operation from one of said first pressure conditions to the other one thereof as said cab travels past a predetermined point toward a selected floor level.

28. Elevator apparatus as defined in claim 24 characterized in that said valve means and said electric control means includes means for varying the flow of pressurized fluid and pilot-controlled unloading valve means operable to control the rate of flow through the pilot portion thereof and responsive thereto to control the flow of fluid through said unloading valve means.

29. Elevator apparatus as defined in claim 24 characterized in that said valve means and electric control means includes speed responsive governor means having a driving connection to the non-stationary one of said rotor means and said screw means which governor means includes means for gradually slowing the approach of said cab to a selected floor level substantially independently of changes in the viscosity of said pressurized fluid due to the temperature fluctuation thereof.

30. Elevator apparatus as defined in claim 1 characterized in that said means for supplying pressurized fluid to said motor-pump means includes fluid flow control means operable to release pressurized fluid therefrom at a predetermined rate to permit downward travel of said cab when said brake means is released.

31. Elevator apparatus as defined in claim 30 characterized in that said pressurized fluid flow control means includes pilot-controlled unloading valve means for controlling the flow of fluid in the pilot portion thereof and responsive thereto to control fluid flow through said unloading valve means.

32. Elevator apparatus as defined in claim 30 characterized in that said means for supplying pressurized fluid includes governor means driven by rotation of one of said rotor means and said screw means and responsive to the rotational speed of said governor means to vary the rate at which pressurized fluid is released to said fluid source thereby to control the travel rate of said cab along said screw means.

33. Elevator apparatus as defined in claim 1 characterized in that said means for controlling the direction of fluid flow through said motor-pump means includes cab acceleration and deceleration control means and said control means including governor actuated means responsive to the rotation of one of said rotor means and said screw means at a pre-selected rate to alter the rate of cab travel along said screw means.

34. Elevator apparatus as defined in claim 33 characterized in that said control means and said governor actuated means includes means cooperating therewith operable to decelerate said cab slowly and smoothly as said cab approaches a selected stop position.

35. Elevator apparatus as defined in claim 1 characterized in that said screw means comprises a plurality of threaded sections having the adjacent abutting ends thereof joined together by differentially threaded coupling means, and locking key means bridging said abutting screw ends and rigidly assembled thereto after said coupling means has been tightly assembled thereby to lock said coupling means against loosening.

36. Elevator apparatus as defined in claim 1 characterized in that said screw means includes a pair of externally threaded sections held joined together between the abutting adjacent ends thereof by differentially threaded coupling means concealed within said sections and so adjusted that said external threads of said screw sections merge accurately with one another at said abutting screw ends, an elongated aligned slot lengthwise of the exterior of said screw sections and bridging said abutting ends which slot is formed after the assembly and tightening of said coupling means, and locking key means snugly secured in said slot crosswise of the abutting ends of said screw sections thereby positively locking said screw sections and coupling means against loosening.

37. Elevator apparatus as defined in claim 1 characterized in the provision of safety decelerator means at the base of said screw means positioned to arrest downward overtravel of said cab, said decelerator means including combination mechanical and hydraulic means cooperating to absorb separate portions of downward overtravel load stresses imparted thereto by said cab.

38. Elevator apparatus as defined in claim 37 characterized in that said safety decelerator means comprises at least one vertically disposed piston and cylinder, spring means normally resiliently supporting said cylinder in an extended position, fluid conduit means interconnecting the opposite ends of said cylinder and including valve means and restrictor means in circuit with a source of pressurized fluid normally operable to maintain said piston extended and near one end of said cylinder, and said restrictor being operable to control the rate of fluid flow between the opposite ends of said cylinder as overtravel of said cab forces said piston to the opposite end of said cylinder.

39. Elevator apparatus as defined in claim 38 characterized in the provision of a plurality of safety decelerator means at the base of said screw and arranged laterally of said screw and connected in parallel to share the load forces imposed thereon by said cab during downward overtravel thereof.

40. Elevator apparatus as defined in claim 1 characterized in that said means for supplying pressurized fluid to said motor-pump means includes motor driven pump means having an inlet connected to a fluid source and an outlet connected to said motor-pump means by a pair of concentric flexible hoses the inner one of which conveys pressurized fluid and the outer one of which normally returns unpressurized fluid from said motor-pump means to said fluid source.

41. Elevator apparatus as defined in claim 1 characterized in the provision of electrically powered means for supplying pressurized fluid to said motor-pump means while said apparatus is in use to propel said cab upwardly along said screw means, and said fall-safe means being additionally automatically responsive to the failure of said means for supplying pressurized fluid to said motor-pump means to permit said rotor means to autorotate slowly down said screw means.

42. Elevator apparatus as defined in claim 1 characterized in the provision of means suspending said screw from the upper end thereof and at the upper and lower ends of said screw means normally holding said screw means against rotation about its axis, and said screw holding means at the lower end thereof being operable to hold said screw means against rotation while said cab moves downwardly therealong should the upper end portion of said screw means become free to rotate by the severance thereof and/or the failure of said upper holding means.

43. Elevator apparatus as defined in claim 1 characterized in the provision of means for supporting said screw means in tension and including means at its upper and lower ends normally holding said screw means stationary, and said lower holding means being operable to support said screw means in compression and to continue holding the same against rotation upon failure of said upper holding means to support a major portion of said screw means in compression.

44. Hydraulically powered elevator apparatus comprising:

a cab coupled to a vertical screw means by rotor means encircling and in mesh with said screw means and journalled on said cab;

hydraulically powered means for rotating one of said rotor means and said screw means relative to one another to propel said cab therealong between different stations;

brake means for holding said rotor means against rotation of said cab it stopped at a selected one of said stations and including hydraulic means responsive to the supply of pressurized fluid to said hydraulically powered means to release said brake means;

motor-driven pump means supported independently of said cab and operatively connected to said hydraulically powered means by flexible hose means; and control means for manually initiating operation of said hydraulically powered means and including means for sensing the approach of said cab to any one of said stations and the departure of said cab therefrom and including means automatically operable in response to the sensed approach or departure of said cab to vary the fluid flow of said hydraulically powered means to gradually decelerate and gradually accelerate cab travel between full speed travel and zero speed travel while said cab completes the approach and departure thereof between a selected pair of said stations.

45. Elevator apparatus as defined in claim 44 characterized in that said hydraulically powered means includes motor-pump means having a driving connection solely with said rotor means and supplied with pressurized fluid to rotate said rotor means upwardly along said screw means during upward cab travel, means for releasing said brake means and permitting said rotor means to auto-rotate downwardly along said screw and permitting said motor-pump means to operate as a pump during downward cab travel, and said hydraulically powered means including means operatively connected in circuit with said means for varying the flow of fluid to accelerate and decelerate cab travel as it departs from an upper station and as it approaches a selected lower station.

46. Elevator apparatus as defined in claim 45 characterized in that said means for varying the rate of fluid flow includes power operated needle valve means.

47. Elevator apparatus as defined in claim 46 characterized in said means for varying the rate of fluid flow includes pilot-controlled flow regulating means the pilot of which is controlled by said needle valve means.

48. Elevator apparatus as defined in claim 44 characterized in the provision of hydraulically powered automatic door means at each of more than two stations served by said elevator apparatus and controlling entrance to said cab, and manually operable control means for initiating a door opening and closing cycle of said automatic door means.

49. Elevator apparatus as defined in claim 48 characterized in the provision of pressure responsive relief valve means for releasing fluid from said automatic means during the door closing cycle to forestall further door closing so long as there is interference with the door closing cycle and thereupon resuming the door closing cycle.

50. Elevator apparatus as defined in claim 48 characterized in the provision of hydraulically controlled means for locking said door closed at the end of a door closing cycle.

51. Elevator apparatus as defined in claim 50 characterized in the provision of power switch means operatively associated with said automatic door operating means for maintaining said hydraulically powered means for rotating said rotor means deactivated so long as said door locking means is unlocked and for reactivating the same as said door is locked closed.

52. Elevator apparatus comprising:

an upright tubular housing having a slot extending therealong;

steep-pitched tubular screw means suspended interiorly and lengthwise of said housing;

rotor means encircling and engaged with said screw means and including means engageable with the interior of said housing for holding the same in a predetermined position transversely thereof;

a cab rigidly supported on said rotor means by bracket means extending through said slot in said tubular housing; and hydraulically powered means operable to rotate said screw means to propel said cab upwardly therealong and operable to permit auto-rotation of said tubular screw means during downward travel of said cab therealong.

53. Elevator apparatus as defined in claim 52 characterized in the provision of roller means lying in radial planes contained in the axes of said tubular means and said screw means and disposed in rolling contact with the inner surface of said tubular housing.

54. Elevator apparatus as defined in claim 52 characterized in that said screw means is tubular.

55. Elevator apparatus as defined in claim 54 characterized in that screw means has a diameter of at least four inches.

56. Elevator apparatus as defined in claim 52 characterized in the provision of fail-safe self-setting brake means for said screw means equipped with hydraulic means for releasing the same in response to the supply of pressurized fluid to said means for rotating said screw means.

57. Elevator apparatus as defined in claim 56 characterized in that said screw means is free to auto-rotate when said brake means is released thereby permitting said cab to travel downwardly therealong.

58. Elevator apparatus as defined in claim 52 characterized in that said tubular means is tubular and includes a plurality of rollers distributed about the exterior thereof having rolling contact with the interior of said tubular housing as said cab is propelled along said screw means whereby said tubular housing functions to support and stabilize both said cab and said screw means throughout cab travel therealong.

59. Elevator apparatus as defined in claim 52 characterized in that said screw means includes at least one pair of screw sections rigidly joined together between the aligned abutting ends thereof by concealed differentially threaded coupling means bridging said abutting ends and so adjusted that the adjacent threads of said screw sections merge precisely with one another, and rigid locking key means bridging said abutting ends installed thereacross after final assembly of said coupling means and operable to lock said coupling means against loosening during the emergency lowering of the cab along said screw means.

60. Elevator apparatus as defined in claim 52 characterized in that said tubular housing provides the major support for said screw means, said load supporting means and said cab mounted thereon.

61. Elevator apparatus as defined in claim 60 characterized in that said tubular housing is rigidly supported in an upright position by means anchored to the lower end thereof.

62. Elevator apparatus as defined in claim 52 in that the lower end of said screw extends downwardly below the lower end of said tubular housing and into a floatingly supported power transmission means operable to rotate said screw means in a direction to propel said cab upwardly along said screw, and support means rigidly supporting said tubular housing without interfering with the floating freedom of said power transmission means.

63. Elevator apparatus comprising:

a cab movable lengthwise of rigid frame means;

steep-pitch screw means suspended from the upper portion of said frame means;

rotor means rotatably engaging said screw means and operable to propel said cab therealong;

means normally holding one only of said screw means and said rotor means against rotation;

hydraulic motor-pump means having a driving connection to said one of said rotor means and said screw means not normally held against rotation;

control means for said elevator apparatus including means supplying fluid to said motor-pump means under pressure in a first direction to propel said cab upwardly along said screw means and for supplying unpressurized fluid to said motor-pump means in the opposite direction to permit downward travel of said cab; and said control means including governor means responsive to an increase in the rate of cab travel in either direction beyond a predetermined rate to alter the rate of cab travel along said screw means.

64. Elevator apparatus as defined in claim 63 characterized in that said control and governor means includes means operable during cab approach to a selected station to slow cab travel whenever said cab travel exceeds a predetermined rate of travel.

65. Elevator apparatus as defined in claim 63 characterized in that said control and governor means includes means operable during cab travel at a fast rate between approaches to a selected station to slow cab travel whenever said cab travel exceeds a predetermined fast rate of travel and operable to permit resumption of fast cab travel as the travel rate decays below said predetermined fast rate.

* * * * *